US008376495B2

(12) United States Patent
Yamazaki et al.

(10) Patent No.: US 8,376,495 B2
(45) Date of Patent: Feb. 19, 2013

(54) PRINTING APPARATUS AND DITHER MASK

(75) Inventors: Satoshi Yamazaki, Nagano (JP); Toshiaki Kakutani, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 581 days.

(21) Appl. No.: 12/605,833

(22) Filed: Oct. 26, 2009

(65) Prior Publication Data

US 2010/0141699 A1 Jun. 10, 2010

(30) Foreign Application Priority Data

Dec. 4, 2008 (JP) ..... 2008-309343

(51) Int. Cl.
*B41J 2/205* (2006.01)

(52) U.S. Cl. ..... 347/15

(58) Field of Classification Search ..... 347/15
See application file for complete search history.

(56) References Cited

U.S. PATENT DOCUMENTS

| | | | | |
|---|---|---|---|---|
| 2006/0193010 | A1 | 8/2006 | Kakutani | |
| 2006/0279789 | A1 | 12/2006 | Yamazaki et al. | |
| 2007/0058202 | A1 | 3/2007 | Kakutani | |
| 2007/0058204 | A1 | 3/2007 | Kakutani | |
| 2007/0091134 | A1 | 4/2007 | Kakutani | |
| 2007/0092151 | A1* | 4/2007 | Takahashi et al. | 382/251 |
| 2007/0115505 | A1 | 5/2007 | Kakutani | |
| 2007/0121135 | A1 | 5/2007 | Kakutani | |
| 2007/0121137 | A1* | 5/2007 | Kakutani | 358/1.9 |
| 2007/0153333 | A1 | 7/2007 | Kakutani | |
| 2007/0216954 | A1 | 9/2007 | Kakutani | |
| 2007/0258110 | A1 | 11/2007 | Kakutani et al. | |
| 2007/0291065 | A1* | 12/2007 | Shibata et al. | 347/15 |
| 2007/0296990 | A1 | 12/2007 | Kakutani | |
| 2008/0024826 | A1 | 1/2008 | Kakutani et al. | |
| 2008/0036812 | A1 | 2/2008 | Kakutani | |
| 2008/0123148 | A1 | 5/2008 | Takahashi et al. | |
| 2008/0130024 | A1 | 6/2008 | Kakutani | |
| 2008/0158611 | A1 | 7/2008 | Kakutani | |
| 2008/0266608 | A1 | 10/2008 | Yamazaki et al. | |

FOREIGN PATENT DOCUMENTS

| | | | |
|---|---|---|---|
| JP | 2007-15359 | A | 1/2007 |
| JP | 2007-49443 | A | 2/2007 |
| JP | 2007-53714 | A | 3/2007 |
| JP | 2007-76246 | A | 3/2007 |
| JP | 2007-98881 | A | 4/2007 |

(Continued)

*Primary Examiner* — Uyen Chau N Le
*Assistant Examiner* — Hoang Tran
(74) *Attorney, Agent, or Firm* — Global IP Counselors, LLP

(57) ABSTRACT

Provided is a printing apparatus that performs printing by moving a print head in main scan directions and sub scan directions relative to a printing medium, including: an input unit that inputs image data constituting an image; a halftone processing unit that converts the input image data to dot data indicating whether or not dots are formed; and a printing unit that performs printing by controlling ejection of ink from the print head based on the result of the halftone process, wherein, in a printing area where an ink duty is in a predetermined range, the printing unit forms dots by forward movement in which the print head relatively moves in one direction of the main scan directions and backward movement in which the print head relatively moves in the direction opposite to the one direction so that a forward-moving dot occurrence ratio that is a ratio of forming the dots by the forward movement and a backward-moving dot occurrence ratio that is a ratio of forming the dots by the backward movement are gradually increased with a biased magnitude relation as the ink duty is increased.

8 Claims, 20 Drawing Sheets

FOREIGN PATENT DOCUMENTS

| | | | |
|---|---|---|---|
| JP | 2007-106097 | A | 4/2007 |
| JP | 2007-116432 | A | 5/2007 |
| JP | 2007-142847 | A | 6/2007 |
| JP | 2007-142848 | A | 6/2007 |
| JP | 2007-142850 | A | 6/2007 |
| JP | 2007-174272 | A | 7/2007 |
| JP | 2007-208786 | A | 8/2007 |
| JP | 2007-245618 | A | 9/2007 |
| JP | 2007-251734 | A | 9/2007 |
| JP | 2008-6591 | A | 1/2008 |
| JP | 2008-23893 | A | 2/2008 |
| JP | 2008-30254 | A | 2/2008 |
| JP | 2008-30432 | A | 2/2008 |
| JP | 2008-37009 | A | 2/2008 |
| JP | 2008-93965 | A | 4/2008 |
| JP | 2008-162078 | A | 7/2008 |
| JP | 2008-162151 | A | 7/2008 |

* cited by examiner

FIG. 4A

| MAIN SCAN NUMBER | −3 | −2 | −1 | 0 | 1 | 2 | 3 | 4 |
|---|---|---|---|---|---|---|---|---|
| MAIN SCAN DIRECTION | → | ← | → | ← | → | ← | → | ← |
| SHEET TRANSPORTING AMOUNT | 15 | 15 | 15 | 15 | 15 | 15 | 15 | 15 |

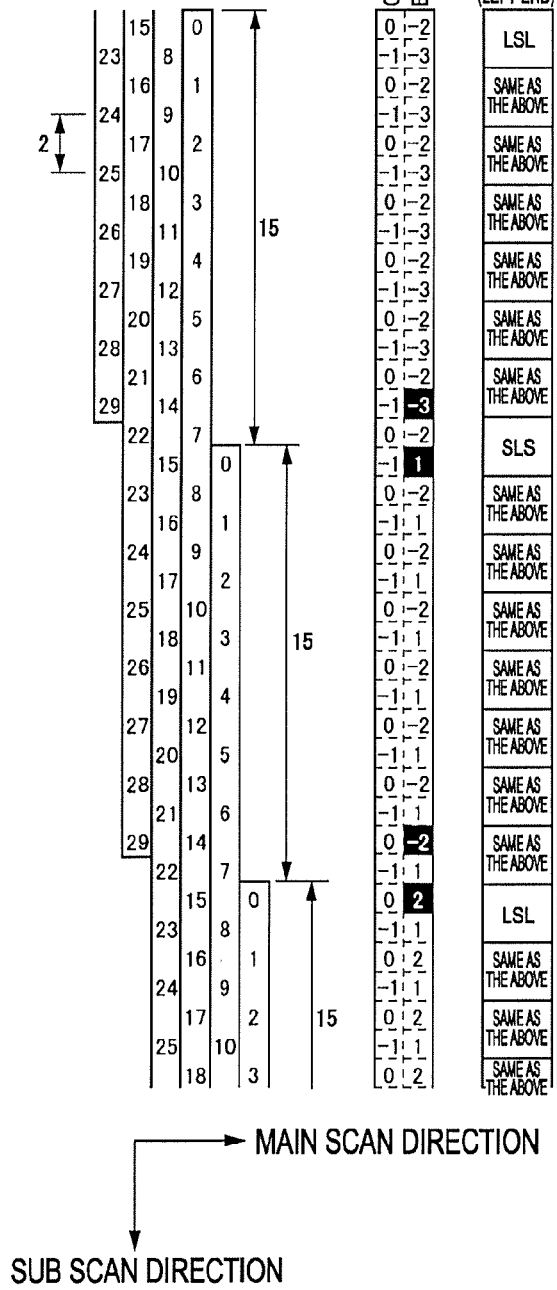

FIG. 4B

| MAIN SCAN NUMBER ODD | MAIN SCAN NUMBER EVEN | DOT FORMING TIMING (LEFT END) |
|---|---|---|
| 0 | −2 | LSL |
| −1 | −3 | |
| 0 | −2 | SAME AS THE ABOVE |
| −1 | −3 | |
| 0 | −2 | SAME AS THE ABOVE |
| −1 | −3 | |
| 0 | −2 | SAME AS THE ABOVE |
| −1 | −3 | |
| 0 | −2 | SAME AS THE ABOVE |
| −1 | −3 | |
| 0 | −2 | SAME AS THE ABOVE |
| −1 | −3 | |
| 0 | −2 | SAME AS THE ABOVE |
| −1 | −3 | |
| 0 | −2 | SLS |
| −1 | 1 | |
| 0 | −2 | SAME AS THE ABOVE |
| −1 | 1 | |
| 0 | −2 | SAME AS THE ABOVE |
| −1 | 1 | |
| 0 | −2 | SAME AS THE ABOVE |
| −1 | 1 | |
| 0 | −2 | SAME AS THE ABOVE |
| −1 | 1 | |
| 0 | −2 | SAME AS THE ABOVE |
| −1 | 1 | |
| 0 | −2 | SAME AS THE ABOVE |
| −1 | 1 | |
| 0 | −2 | SAME AS THE ABOVE |
| −1 | 1 | |
| 0 | 2 | LSL |
| −1 | 1 | |
| 0 | 2 | SAME AS THE ABOVE |
| −1 | 1 | |
| 0 | 2 | SAME AS THE ABOVE |
| −1 | 1 | |
| 0 | 2 | SAME AS THE ABOVE |

FIG. 4C

HATCHING INDICATION: LONG DOT (L)
INVERSION INDICATION: SHORT DOT (S)

SHEET WIDTH

| ROW \ COLUMN | 1 | 2 | 3 | 4 | 5 | 6 | 7 | 8 | 9 | 10 | 11 | 12 | 13 | 14 | 15 | 16 | DOT FORMING TIMING (RIGHT END) |
|---|---|---|---|---|---|---|---|---|---|---|---|---|---|---|---|---|---|
| | NOZZLE NUMBER | | | | | | | | | | | | | | | | |
| 1 | 0 | 15 | 0 | 15 | 0 | 15 | 0 | 15 | 0 | 15 | 0 | 15 | 0 | 15 | 0 | 15 | SLS |
| 2 | 8 | 23 | 8 | 23 | 8 | 23 | 8 | 23 | 8 | 23 | 8 | 23 | 8 | 23 | 8 | 23 | |
| 3 | 1 | 16 | 1 | 16 | 1 | 16 | 1 | 16 | 1 | 16 | 1 | 16 | 1 | 16 | 1 | 16 | SAME AS THE ABOVE |
| 4 | 9 | 24 | 9 | 24 | 9 | 24 | 9 | 24 | 9 | 24 | 9 | 24 | 9 | 24 | 9 | 24 | |
| 5 | 2 | 17 | 2 | 17 | 2 | 17 | 2 | 17 | 2 | 17 | 2 | 17 | 2 | 17 | 2 | 17 | SAME AS THE ABOVE |
| 6 | 10 | 25 | 10 | 25 | 10 | 25 | 10 | 25 | 10 | 25 | 10 | 25 | 10 | 25 | 10 | 25 | |
| 7 | 3 | 18 | 3 | 18 | 3 | 18 | 3 | 18 | 3 | 18 | 3 | 18 | 3 | 18 | 3 | 18 | SAME AS THE ABOVE |
| 8 | 11 | 26 | 11 | 26 | 11 | 26 | 11 | 26 | 11 | 26 | 11 | 26 | 11 | 26 | 11 | 26 | |
| 9 | 4 | 19 | 4 | 19 | 4 | 19 | 4 | 19 | 4 | 19 | 4 | 19 | 4 | 19 | 4 | 19 | SAME AS THE ABOVE |
| 10 | 12 | 27 | 12 | 27 | 12 | 27 | 12 | 27 | 12 | 27 | 12 | 27 | 12 | 27 | 12 | 27 | |
| 11 | 5 | 20 | 5 | 20 | 5 | 20 | 5 | 20 | 5 | 20 | 5 | 20 | 5 | 20 | 5 | 20 | SAME AS THE ABOVE |
| 12 | 13 | 28 | 13 | 28 | 13 | 28 | 13 | 28 | 13 | 28 | 13 | 28 | 13 | 28 | 13 | 28 | |
| 13 | 6 | 21 | 6 | 21 | 6 | 21 | 6 | 21 | 6 | 21 | 6 | 21 | 6 | 21 | 6 | 21 | SAME AS THE ABOVE |
| 14 | 14 | 29 | 14 | 29 | 14 | 29 | 14 | 29 | 14 | 29 | 14 | 29 | 14 | 29 | 14 | 29 | |
| 15 | 7 | 22 | 7 | 22 | 7 | 22 | 7 | 22 | 7 | 22 | 7 | 22 | 7 | 22 | 7 | 22 | LSL |
| 16 | 15 | 0 | 15 | 0 | 15 | 0 | 15 | 0 | 15 | 0 | 15 | 0 | 15 | 0 | 15 | 0 | |
| 17 | 8 | 23 | 8 | 23 | 8 | 23 | 8 | 23 | 8 | 23 | 8 | 23 | 8 | 23 | 8 | 23 | SAME AS THE ABOVE |
| 18 | 16 | 1 | 16 | 1 | 16 | 1 | 16 | 1 | 16 | 1 | 16 | 1 | 16 | 1 | 16 | 1 | |
| 19 | 9 | 24 | 9 | 24 | 9 | 24 | 9 | 24 | 9 | 24 | 9 | 24 | 9 | 24 | 9 | 24 | SAME AS THE ABOVE |
| 20 | 17 | 2 | 17 | 2 | 17 | 2 | 17 | 2 | 17 | 2 | 17 | 2 | 17 | 2 | 17 | 2 | |
| 21 | 10 | 25 | 10 | 25 | 10 | 25 | 10 | 25 | 10 | 25 | 10 | 25 | 10 | 25 | 10 | 25 | SAME AS THE ABOVE |
| 22 | 18 | 3 | 18 | 3 | 18 | 3 | 18 | 3 | 18 | 3 | 18 | 3 | 18 | 3 | 18 | 3 | |
| 23 | 11 | 26 | 11 | 26 | 11 | 26 | 11 | 26 | 11 | 26 | 11 | 26 | 11 | 26 | 11 | 26 | SAME AS THE ABOVE |
| 24 | 19 | 4 | 19 | 4 | 19 | 4 | 19 | 4 | 19 | 4 | 19 | 4 | 19 | 4 | 19 | 4 | |
| 25 | 12 | 27 | 12 | 27 | 12 | 27 | 12 | 27 | 12 | 27 | 12 | 27 | 12 | 27 | 12 | 27 | SAME AS THE ABOVE |
| 26 | 20 | 5 | 20 | 5 | 20 | 5 | 20 | 5 | 20 | 5 | 20 | 5 | 20 | 5 | 20 | 5 | |
| 27 | 13 | 28 | 13 | 28 | 13 | 28 | 13 | 28 | 13 | 28 | 13 | 28 | 13 | 28 | 13 | 28 | SAME AS THE ABOVE |
| 28 | 21 | 6 | 21 | 6 | 21 | 6 | 21 | 6 | 21 | 6 | 21 | 6 | 21 | 6 | 21 | 6 | |
| 29 | 14 | 29 | 14 | 29 | 14 | 29 | 14 | 29 | 14 | 29 | 14 | 29 | 14 | 29 | 14 | 29 | SAME AS THE ABOVE |
| 30 | 22 | 7 | 22 | 7 | 22 | 7 | 22 | 7 | 22 | 7 | 22 | 7 | 22 | 7 | 22 | 7 | |
| 31 | 15 | 0 | 15 | 0 | 15 | 0 | 15 | 0 | 15 | 0 | 15 | 0 | 15 | 0 | 15 | 0 | SLS |
| 32 | 23 | 8 | 23 | 8 | 23 | 8 | 23 | 8 | 23 | 8 | 23 | 8 | 23 | 8 | 23 | 8 | |
| 33 | 16 | 1 | 16 | 1 | 16 | 1 | 16 | 1 | 16 | 1 | 16 | 1 | 16 | 1 | 16 | 1 | SAME AS THE ABOVE |
| 34 | 24 | 9 | 24 | 9 | 24 | 9 | 24 | 9 | 24 | 9 | 24 | 9 | 24 | 9 | 24 | 9 | |
| 35 | 17 | 2 | 17 | 2 | 17 | 2 | 17 | 2 | 17 | 2 | 17 | 2 | 17 | 2 | 17 | 2 | SAME AS THE ABOVE |
| 36 | 25 | 10 | 25 | 10 | 25 | 10 | 25 | 10 | 25 | 10 | 25 | 10 | 25 | 10 | 25 | 10 | |
| 37 | 18 | 3 | 18 | 3 | 18 | 3 | 18 | 3 | 18 | 3 | 18 | 3 | 18 | 3 | 18 | 3 | SAME AS THE ABOVE |

FIG. 5A
| MAIN SCAN NUMBER | −3 | −2 | −1 | 0 | 1 | 2 | 3 | 4 |
|---|---|---|---|---|---|---|---|---|
| MAIN SCAN DIRECTION | → | ← | → | ← | → | ← | → | ← |
| SHEET TRANSPORTING AMOUNT | 15 | 15 | 15 | 15 | 15 | 15 | 15 | 15 |
FIG. 5B
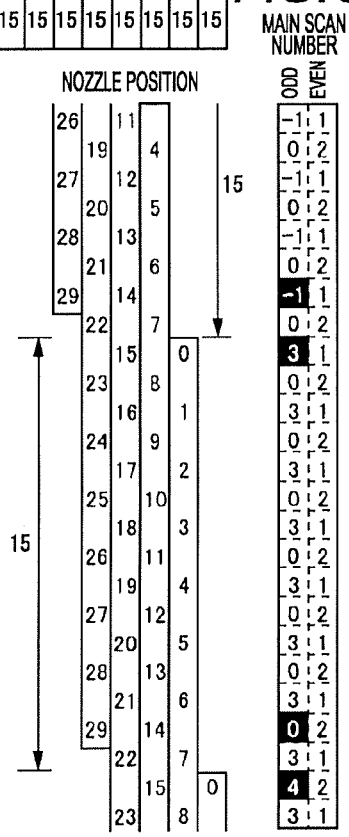
FIG. 5C
HATCHING INDICATION: LONG DOT (L)
INVERSION INDICATION: SHORT DOT (S)
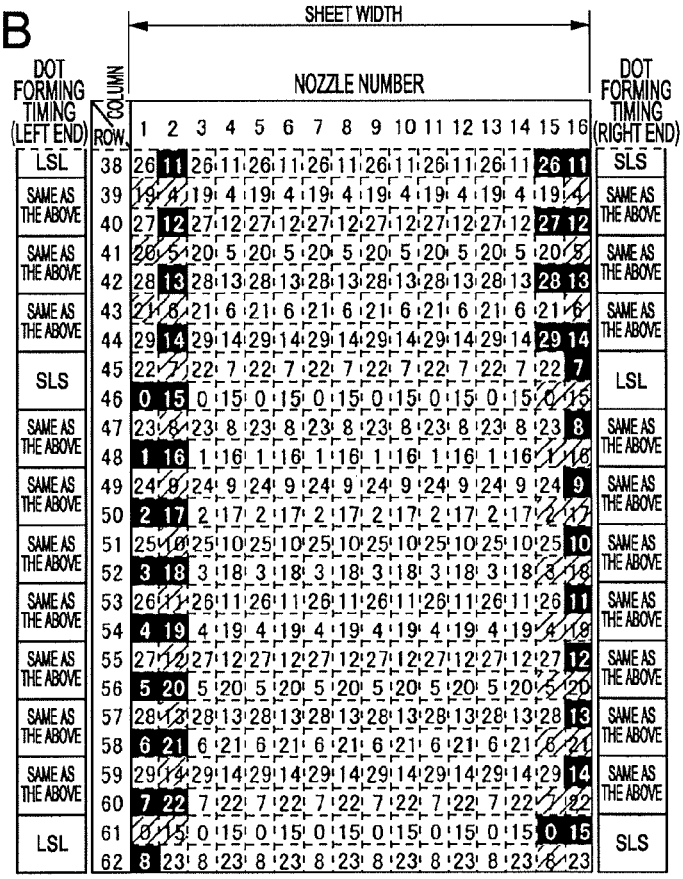

FIG. 6A

| MAIN SCAN NUMBER | −3 | −2 | −1 | 0 | 1 | 2 |
|---|---|---|---|---|---|---|
| MAIN SCAN DIRECTION | → | ← | → | ← | → | ← |
| SHEET TRANSPORTING AMOUNT | 15 | 15 | 15 | 15 | 15 | 15 |

NOZZLE POSITION

| | | | | | |
|---|---|---|---|---|---|
| | 15 | | 0 | | |
| 23 | | 8 | | | |
| | 16 | | 1 | | |
| 24 | | 9 | | | |
| | 17 | | 2 | | |
| 25 | | 10 | | | |
| | 18 | | 3 | | |
| 26 | | 11 | | | |
| | 19 | | 4 | | |
| 27 | | 12 | | | |
| | 20 | | 5 | | |
| 28 | | 13 | | | |
| | 21 | | 6 | | |
| 29 | | 14 | | | |
| | 22 | | 7 | | |
| | | 15 | | 0 | |
| | 23 | | 8 | | |
| | | 16 | | 1 | |
| | 24 | | 9 | | |
| | | 17 | | 2 | |
| | 25 | | 10 | | |
| | | 18 | | 3 | |
| | 26 | | 11 | | |
| | | 19 | | 4 | |
| | 27 | | 12 | | |
| | | 20 | | 5 | |
| | 28 | | 13 | | |
| | | 21 | | 6 | |
| | 29 | | 14 | | |
| | | 22 | | 7 | |
| | | | 15 | | 0 |
| | | 23 | | 8 | |
| | | | 16 | | 1 |
| | | 24 | | 9 | |
| | | | 17 | | 2 |
| | | 25 | | 10 | |
| | | | 18 | | 3 |

FIG. 6B

| MAIN SCAN NUMBER ODD | MAIN SCAN NUMBER EVEN |
|---|---|
| 0 | −2 |
| −1 | −3 |
| 0 | −2 |
| −1 | −3 |
| 0 | −2 |
| −1 | −3 |
| 0 | −2 |
| −1 | −3 |
| 0 | −2 |
| −1 | −3 |
| 0 | −2 |
| −1 | **−3** |
| 0 | −2 |
| −1 | **1** |
| 0 | −2 |
| −1 | 1 |
| 0 | −2 |
| −1 | 1 |
| 0 | −2 |
| −1 | 1 |
| 0 | −2 |
| −1 | 1 |
| 0 | −2 |
| −1 | 1 |
| 0 | −2 |
| −1 | 1 |
| 0 | **−2** |
| −1 | 1 |
| 0 | **2** |
| −1 | 1 |
| 0 | 2 |
| −1 | 1 |
| 0 | 2 |
| −1 | 1 |
| 0 | 2 |

FIG. 6C

NOZZLE NUMBER

| ROW \ COLUMN | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 1 | 0 | 15 | 0 | 15 | 0 | 15 | 0 | 15 | 0 | 15 | 0 | 15 | 0 | 15 | 0 | 15 |
| 2 | 8 | 23 | 8 | 23 | 8 | 23 | 8 | 23 | 8 | 23 | 8 | 23 | 8 | 23 | 8 | 23 |
| 3 | 1 | 16 | 1 | 16 | 1 | 16 | 1 | 16 | 1 | 16 | 1 | 16 | 1 | 16 | 1 | 16 |
| 4 | 9 | 24 | 9 | 24 | 9 | 24 | 9 | 24 | 9 | 24 | 9 | 24 | 9 | 24 | 9 | 24 |
| 5 | 2 | 17 | 2 | 17 | 2 | 17 | 2 | 17 | 2 | 17 | 2 | 17 | 2 | 17 | 2 | 17 |
| 6 | 10 | 25 | 10 | 25 | 10 | 25 | 10 | 25 | 10 | 25 | 10 | 25 | 10 | 25 | 10 | 25 |
| 7 | 3 | 18 | 3 | 18 | 3 | 18 | 3 | 18 | 3 | 18 | 3 | 18 | 3 | 18 | 3 | 18 |
| 8 | 11 | 26 | 11 | 26 | 11 | 26 | 11 | 26 | 11 | 26 | 11 | 26 | 11 | 26 | 11 | 26 |
| 9 | 4 | 19 | 4 | 19 | 4 | 19 | 4 | 19 | 4 | 19 | 4 | 19 | 4 | 19 | 4 | 19 |
| 10 | 12 | 27 | 12 | 27 | 12 | 27 | 12 | 27 | 12 | 27 | 12 | 27 | 12 | 27 | 12 | 27 |
| 11 | 5 | 20 | 5 | 20 | 5 | 20 | 5 | 20 | 5 | 20 | 5 | 20 | 5 | 20 | 5 | 20 |
| 12 | 13 | 28 | 13 | 28 | 13 | 28 | 13 | 28 | 13 | 28 | 13 | 28 | 13 | 28 | 13 | 28 |
| 13 | 6 | 21 | 6 | 21 | 6 | 21 | 6 | 21 | 6 | 21 | 6 | 21 | 6 | 21 | 6 | 21 |
| 14 | 14 | 29 | 14 | 29 | 14 | 29 | 14 | 29 | 14 | 29 | 14 | 29 | 14 | 29 | 14 | 29 |
| 15 | 7 | 22 | 7 | 22 | 7 | 22 | 7 | 22 | 7 | 22 | 7 | 22 | 7 | 22 | 7 | 22 |
| 16 | 15 | 0 | 15 | 0 | 15 | 0 | 15 | 0 | 15 | 0 | 15 | 0 | 15 | 0 | 15 | 0 |
| 17 | 8 | 23 | 8 | 23 | 8 | 23 | 8 | 23 | 8 | 23 | 8 | 23 | 8 | 23 | 8 | 23 |
| 18 | 16 | 1 | 16 | 1 | 16 | 1 | 16 | 1 | 16 | 1 | 16 | 1 | 16 | 1 | 16 | 1 |
| 19 | 9 | 24 | 9 | 24 | 9 | 24 | 9 | 24 | 9 | 24 | 9 | 24 | 9 | 24 | 9 | 24 |
| 20 | 17 | 2 | 17 | 2 | 17 | 2 | 17 | 2 | 17 | 2 | 17 | 2 | 17 | 2 | 17 | 2 |
| 21 | 10 | 25 | 10 | 25 | 10 | 25 | 10 | 25 | 10 | 25 | 10 | 25 | 10 | 25 | 10 | 25 |
| 22 | 18 | 3 | 18 | 3 | 18 | 3 | 18 | 3 | 18 | 3 | 18 | 3 | 18 | 3 | 18 | 3 |
| 23 | 11 | 26 | 11 | 26 | 11 | 26 | 11 | 26 | 11 | 26 | 11 | 26 | 11 | 26 | 11 | 26 |
| 24 | 19 | 4 | 19 | 4 | 19 | 4 | 19 | 4 | 19 | 4 | 19 | 4 | 19 | 4 | 19 | 4 |
| 25 | 12 | 27 | 12 | 27 | 12 | 27 | 12 | 27 | 12 | 27 | 12 | 27 | 12 | 27 | 12 | 27 |
| 26 | 20 | 5 | 20 | 5 | 20 | 5 | 20 | 5 | 20 | 5 | 20 | 5 | 20 | 5 | 20 | 5 |
| 27 | 13 | 28 | 13 | 28 | 13 | 28 | 13 | 28 | 13 | 28 | 13 | 28 | 13 | 28 | 13 | 28 |
| 28 | 21 | 6 | 21 | 6 | 21 | 6 | 21 | 6 | 21 | 6 | 21 | 6 | 21 | 6 | 21 | 6 |
| 29 | 14 | 29 | 14 | 29 | 14 | 29 | 14 | 29 | 14 | 29 | 14 | 29 | 14 | 29 | 14 | 29 |
| 30 | 22 | 7 | 22 | 7 | 22 | 7 | 22 | 7 | 22 | 7 | 22 | 7 | 22 | 7 | 22 | 7 |
| 31 | 15 | 0 | 15 | 0 | 15 | 0 | 15 | 0 | 15 | 0 | 15 | 0 | 15 | 0 | 15 | 0 |
| 32 | 23 | 8 | 23 | 8 | 23 | 8 | 23 | 8 | 23 | 8 | 23 | 8 | 23 | 8 | 23 | 8 |
| 33 | 16 | 1 | 16 | 1 | 16 | 1 | 16 | 1 | 16 | 1 | 16 | 1 | 16 | 1 | 16 | 1 |
| 34 | 24 | 9 | 24 | 9 | 24 | 9 | 24 | 9 | 24 | 9 | 24 | 9 | 24 | 9 | 24 | 9 |
| 35 | 17 | 2 | 17 | 2 | 17 | 2 | 17 | 2 | 17 | 2 | 17 | 2 | 17 | 2 | 17 | 2 |
| 36 | 25 | 10 | 25 | 10 | 25 | 10 | 25 | 10 | 25 | 10 | 25 | 10 | 25 | 10 | 25 | 10 |
| 37 | 18 | 3 | 18 | 3 | 18 | 3 | 18 | 3 | 18 | 3 | 18 | 3 | 18 | 3 | 18 | 3 |

FIG. 6D

| ORDER OF MAIN SCAN DIRECTIONS |
|---|
| → ← → ← |
| SAME AS THE ABOVE |
| SAME AS THE ABOVE |
| SAME AS THE ABOVE |
| SAME AS THE ABOVE |
| SAME AS THE ABOVE |
| SAME AS THE ABOVE |
| ← → ← → |
| SAME AS THE ABOVE |
| SAME AS THE ABOVE |
| SAME AS THE ABOVE |
| SAME AS THE ABOVE |
| SAME AS THE ABOVE |
| SAME AS THE ABOVE |
| → ← → ← |
| SAME AS THE ABOVE |
| SAME AS THE ABOVE |
| SAME AS THE ABOVE |
| SAME AS THE ABOVE |

FIG. 10A

| | COLUMN 1 | COLUMN 2 | COLUMN 3 | COLUMN 4 | COLUMN 5 | COLUMN 6 | COLUMN 7 | COLUMN 8 |
|---|---|---|---|---|---|---|---|---|
| ROW 1 | → | → | → | → | → | → | → | → |
| ROW 2 | ← | ← | ← | ← | ← | ← | ← | ← |
| ROW 3 | → | → | → | → | → | → | → | → |
| ROW 4 | ← | ← | ← | ← | ← | ← | ← | ← |
| ROW 5 | → | → | → | → | → | → | → | → |
| ROW 6 | ← | ← | ← | ← | ← | ← | ← | ← |
| ROW 7 | → | → | → | → | → | → | → | → |
| ROW 8 | ← | ← | ← | ← | ← | ← | ← | ← |

FIG. 10B

| | 1 | 2 | 3 | 4 | 5 | 6 | 7 | 8 |
|---|---|---|---|---|---|---|---|---|
| 1 | → | ← | → | ← | → | ← | → | ← |
| 2 | → | ← | → | ← | → | ← | → | ← |
| 3 | → | ← | → | ← | → | ← | → | ← |
| 4 | → | ← | → | ← | → | ← | → | ← |
| 5 | → | ← | → | ← | → | ← | → | ← |
| 6 | → | ← | → | ← | → | ← | → | ← |
| 7 | → | ← | → | ← | → | ← | → | ← |
| 8 | → | ← | → | ← | → | ← | → | ← |

FIG. 10C

| | 1 | 2 | 3 | 4 | 5 | 6 | 7 | 8 |
|---|---|---|---|---|---|---|---|---|
| 1 | → | ← | → | ← | → | ← | → | ← |
| 2 | ← | → | ← | → | ← | → | ← | → |
| 3 | → | ← | → | ← | → | ← | → | ← |
| 4 | ← | → | ← | → | ← | → | ← | → |
| 5 | → | ← | → | ← | → | ← | → | ← |
| 6 | ← | → | ← | → | ← | → | ← | → |
| 7 | → | ← | → | ← | → | ← | → | ← |
| 8 | ← | → | ← | → | ← | → | ← | → |

FIG. 11A

| | COLUMN 1 | COLUMN 2 | COLUMN 3 | COLUMN 4 | COLUMN 5 | COLUMN 6 | COLUMN 7 | COLUMN 8 |
|---|---|---|---|---|---|---|---|---|
| ROW 1 | 1 | 1 | 1 | 1 | 1 | 1 | 1 | 1 |
| ROW 2 | 2 | 2 | 2 | 2 | 2 | 2 | 2 | 2 |
| ROW 3 | 1 | 1 | 1 | 1 | 1 | 1 | 1 | 1 |
| ROW 4 | 2 | 2 | 2 | 2 | 2 | 2 | 2 | 2 |
| ROW 5 | 1 | 1 | 1 | 1 | 1 | 1 | 1 | 1 |
| ROW 6 | 2 | 2 | 2 | 2 | 2 | 2 | 2 | 2 |
| ROW 7 | 1 | 1 | 1 | 1 | 1 | 1 | 1 | 1 |
| ROW 8 | 2 | 2 | 2 | 2 | 2 | 2 | 2 | 2 |

M

FIG. 11B

| | 1 | 2 | 3 | 4 | 5 | 6 | 7 | 8 |
|---|---|---|---|---|---|---|---|---|
| 1 | 1 | 1 | 1 | 1 | 1 | 1 | 1 | 1 |
| 2 | | | | | | | | |
| 3 | 1 | 1 | 1 | 1 | 1 | 1 | 1 | 1 |
| 4 | | | | | | | | |
| 5 | 1 | 1 | 1 | 1 | 1 | 1 | 1 | 1 |
| 6 | | | | | | | | |
| 7 | 1 | 1 | 1 | 1 | 1 | 1 | 1 | 1 |
| 8 | | | | | | | | |

M1

FIG. 11C

| | 1 | 2 | 3 | 4 | 5 | 6 | 7 | 8 |
|---|---|---|---|---|---|---|---|---|
| 1 | | | | | | | | |
| 2 | 2 | 2 | 2 | 2 | 2 | 2 | 2 | 2 |
| 3 | | | | | | | | |
| 4 | 2 | 2 | 2 | 2 | 2 | 2 | 2 | 2 |
| 5 | | | | | | | | |
| 6 | 2 | 2 | 2 | 2 | 2 | 2 | 2 | 2 |
| 7 | | | | | | | | |
| 8 | 2 | 2 | 2 | 2 | 2 | 2 | 2 | 2 |

M2

FIG. 13

| | COLUMN 1 | COLUMN 2 | COLUMN 3 | COLUMN 4 | COLUMN 5 | COLUMN 6 | COLUMN 7 | COLUMN 8 |
|---|---|---|---|---|---|---|---|---|
| ROW 1 | | ● | | | | | | |
| ROW 2 | | | | | | | | ● |
| ROW 3 | | | ● | | | ● | | |
| ROW 4 | | | | | | | | |
| ROW 5 | | | | | | | | ● |
| ROW 6 | | | | ● | | | | |
| ROW 7 | | ● | | | | ● | | |
| ROW 8 | | | | | | | | |

FIG. 14

| | COLUMN 1 | COLUMN 2 | COLUMN 3 | COLUMN 4 | COLUMN 5 | COLUMN 6 | COLUMN 7 | COLUMN 8 |
|---|---|---|---|---|---|---|---|---|
| ROW 1 | 0 | 1 | 0 | 0 | 0 | 0 | 0 | 0 |
| ROW 2 | 0 | 0 | 0 | 0 | 0 | 0 | 0 | 1 |
| ROW 3 | 0 | 0 | 1 | 0 | 0 | 1 | 0 | 0 |
| ROW 4 | 0 | 0 | 0 | 0 | 0 | 0 | 0 | 0 |
| ROW 5 | 0 | 0 | 0 | 0 | 0 | 0 | 0 | 1 |
| ROW 6 | 0 | 0 | 0 | 1 | 0 | 0 | 0 | 0 |
| ROW 7 | 0 | 1 | 0 | 0 | 0 | 1 | 0 | 0 |
| ROW 8 | 0 | 0 | 0 | 0 | 0 | 0 | 0 | 0 |

FIG. 15

| | COLUMN 1 | COLUMN 2 | COLUMN 3 | COLUMN 4 | COLUMN 5 |
|---|---|---|---|---|---|
| ROW 1 | 0 | 1 | 2 | 1 | 0 |
| ROW 2 | 1 | 3 | 4 | 3 | 1 |
| ROW 3 | 2 | 4 | 5 | 4 | 2 |
| ROW 4 | 1 | 3 | 4 | 3 | 1 |
| ROW 5 | 0 | 1 | 2 | 1 | 0 |

FIG. 16

| | | | | | | | | | 1 | 2 | 3 | 4 | 5 | 6 | 7 | 8 | | | | | | | | |
|---|---|---|---|---|---|---|---|---|---|---|---|---|---|---|---|---|---|---|---|---|---|---|---|---|
| | 0 | 1 | 0 | 0 | 0 | 0 | 0 | 0 | 0 | 1 | 0 | 0 | 0 | 0 | 0 | 0 | 0 | 1 | 0 | 0 | 0 | 0 | 0 | 0 |
| | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 1 |
| | 0 | 0 | 1 | 0 | 0 | 1 | 0 | 0 | 0 | 0 | 1 | 0 | 0 | 1 | 0 | 0 | 0 | 0 | 1 | 0 | 0 | 1 | 0 | 0 |
| | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 1 |
| | 0 | 0 | 0 | 1 | 0 | 0 | 0 | 0 | 0 | 0 | 0 | 1 | 0 | 0 | 0 | 0 | 0 | 0 | 0 | 1 | 0 | 0 | 0 | 0 |
| | 0 | 1 | 0 | 0 | 0 | 1 | 0 | 0 | 0 | 1 | 0 | 0 | 0 | 1 | 0 | 0 | 0 | 1 | 0 | 0 | 0 | 1 | 0 | 0 |
| | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 1 | 0 | 1 | 0 | 0 | 0 | 0 | 0 | 0 | 0 | 1 | 0 | 0 | 0 | 0 | 0 | 0 | 0 | 1 | 0 | 0 | 0 | 0 | 0 | 0 |
| 2 | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 1 |
| 3 | 0 | 0 | 1 | 0 | 0 | 1 | 0 | 0 | 0 | 0 | 1 | 0 | 0 | 1 | 0 | 0 | 0 | 0 | 1 | 0 | 0 | 1 | 0 | 0 |
| 4 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 5 | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 1 |
| 6 | 0 | 0 | 0 | 1 | 0 | 0 | 0 | 0 | 0 | 0 | 0 | 1 | 0 | 0 | 0 | 0 | 0 | 0 | 0 | 1 | 0 | 0 | 0 | 0 |
| 7 | 0 | 1 | 0 | 0 | 0 | 1 | 0 | 0 | 0 | 1 | 0 | 0 | 0 | 1 | 0 | 0 | 0 | 1 | 0 | 0 | 0 | 1 | 0 | 0 |
| 8 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | 0 | 1 | 0 | 0 | 0 | 0 | 0 | 0 | 0 | 1 | 0 | 0 | 0 | 0 | 0 | 0 | 0 | 1 | 0 | 0 | 0 | 0 | 0 | 0 |
| | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 1 |
| | 0 | 0 | 1 | 0 | 0 | 1 | 0 | 0 | 0 | 0 | 1 | 0 | 0 | 1 | 0 | 0 | 0 | 0 | 1 | 0 | 0 | 1 | 0 | 0 |
| | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| | 0 | 0 | 0 | 0 | 0 | 0 | 0 | 1 | 0 | 0 | 0 | 0 | 0 | 0 | 0 | 1 | 0 | 0 | 0 | 0 | 0 | 0 | 0 | 1 |
| | 0 | 0 | 0 | 1 | 0 | 0 | 0 | 0 | 0 | 0 | 0 | 1 | 0 | 0 | 0 | 0 | 0 | 0 | 0 | 1 | 0 | 0 | 0 | 0 |
| | 0 | 1 | 0 | 0 | 0 | 1 | 0 | 0 | 0 | 1 | 0 | 0 | 0 | 1 | 0 | 0 | 0 | 1 | 0 | 0 | 0 | 1 | 0 | 0 |
| | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

FIG. 17

| | COLUMN 1 | COLUMN 2 | COLUMN 3 | COLUMN 4 | COLUMN 5 | COLUMN 6 | COLUMN 7 | COLUMN 8 |
|---|---|---|---|---|---|---|---|---|
| ROW 1 | 8 | 9 | 7 | 3 | 2 | 5 | 5 | 6 |
| ROW 2 | 8 | 9 | 7 | 5 | 4 | 6 | 7 | 7 |
| ROW 3 | 7 | 7 | 6 | 6 | 6 | 6 | 8 | 8 |
| ROW 4 | 5 | 4 | 5 | 6 | 5 | 5 | 7 | 7 |
| ROW 5 | 5 | 6 | 6 | 5 | 5 | 7 | 6 | 5 |
| ROW 6 | 6 | 7 | 7 | 7 | 7 | 7 | 6 | 6 |
| ROW 7 | 6 | 8 | 8 | 8 | 7 | 6 | 5 | 6 |
| ROW 8 | 7 | 8 | 7 | 5 | 4 | 4 | 4 | 5 |

FIG. 18

| | COLUMN 1 | COLUMN 2 | COLUMN 3 | COLUMN 4 | COLUMN 5 | COLUMN 6 | COLUMN 7 | COLUMN 8 |
|---|---|---|---|---|---|---|---|---|
| ROW 1 | | ● | | | | | | |
| ROW 2 | | | | | | | | |
| ROW 3 | | | ● | | | ● | | |
| ROW 4 | | | | | | | | |
| ROW 5 | | | | | | | | ● |
| ROW 6 | | | | | | | | |
| ROW 7 | | ● | | | | ● | | |
| ROW 8 | | | | | | | | |

FIG. 19

| | COLUMN 1 | COLUMN 2 | COLUMN 3 | COLUMN 4 | COLUMN 5 | COLUMN 6 | COLUMN 7 | COLUMN 8 |
|---|---|---|---|---|---|---|---|---|
| ROW 1 | 37 | 44 | 35 | 15 | 10 | 24 | 22 | 26 |
| ROW 2 | 36 | 43 | 35 | 25 | 20 | 28 | 31 | 30 |
| ROW 3 | 32 | 34 | 30 | 30 | 30 | 29 | 37 | 36 |
| ROW 4 | 24 | 20 | 24 | 28 | 24 | 25 | 34 | 33 |
| ROW 5 | 25 | 29 | 27 | 21 | 22 | 34 | 30 | 25 |
| ROW 6 | 30 | 33 | 31 | 30 | 31 | 33 | 30 | 30 |
| ROW 7 | 30 | 39 | 37 | 36 | 32 | 29 | 25 | 30 |
| ROW 8 | 34 | 40 | 34 | 23 | 19 | 20 | 19 | 23 |

FIG. 20

| | COLUMN 1 | COLUMN 2 | COLUMN 3 | COLUMN 4 | COLUMN 5 | COLUMN 6 | COLUMN 7 | COLUMN 8 |
|---|---|---|---|---|---|---|---|---|
| ROW 1 | 37 | COMPLETED | 35 | 15 | 10 | 24 | 22 | 26 |
| ROW 2 | | | | | | | | |
| ROW 3 | 32 | 34 | COMPLETED | 30 | 30 | COMPLETED | 37 | 36 |
| ROW 4 | | | | | | | | |
| ROW 5 | 25 | 29 | 27 | 21 | 22 | 34 | 30 | COMPLETED |
| ROW 6 | | | | | | | | |
| ROW 7 | 30 | COMPLETED | 37 | 36 | 32 | COMPLETED | 25 | 30 |
| ROW 8 | | | | | | | | |

$$\text{RMS GRAININESS} = \sqrt{\frac{\Sigma(\text{EVALUATION VALUE} - \text{MEAN OF EVALUATION VALUE})^2}{\text{NUMBER OF PIXELS}}}$$

PRINTING APPARATUS AND DITHER MASK

BACKGROUND

1. Technical Field

The invention relates to a printing technology of performing printing by relatively moving a print head with respect to a printing medium in a main scan direction and a sub scan direction.

2. Related Art

Recently, serial ink jet printers that perform printing by ejecting ink while relatively moving a print head with respect to a printing medium in a main scan direction and a sub scan direction have been provided. In general, in order to increase the printing speed, the serial ink jet printer employs bidirectional printing, in which ink is ejected in bidirectional (that is, forward-moving directional and backward-moving directional) main scans between the forward-moving main scan and the backward-moving main scan of the print head (refer to, for example, JP-A-2007-49443).

However, the bidirectional printing scheme has problems that are caused by mechanisms thereof. For example, if a printing apparatus reciprocatingly moves a print head from the left end of a printing medium in the main scan direction as one reciprocating movement, in the right end of the printing medium, just after dots are formed by the forward movement of the print head, dots are formed by the backward movement thereof. On the other hand, in the left end of the printing medium, just after the forward movement starts, dots are formed; and after a reciprocating time of the print head elapses, dots are formed by the backward movement thereof. Since the difference in dot forming timings is changed every time that the print head is moved in the sub scan direction, the difference causes non-uniformity in concentration in the sub scan direction in units of sub scan direction transporting amount (this phenomenon is also described in detail in the embodiments). This problem is particularly serious in a large-paper printer, which needs a relatively long time for the reciprocating movement of the print head.

SUMMARY

An advantage of some aspects of the invention is to suppress deterioration in quality of a printing image caused by bidirectional printing.

The invention is contrived so as to solve at least a portion of the aforementioned problems. The invention can be implemented as the following aspects or application examples.

Application Example 1

According to an aspect of the invention, there is provided a printing apparatus that performs printing by moving a print head in main scan directions and sub scan directions relative to a printing medium, comprising: an input unit that inputs image data constituting an image; a halftone processing unit that converts the input image data to dot data indicating whether or not dots are formed; and a printing unit that performs printing by controlling ejection of ink from the print head based on the result of the halftone process, wherein, in a printing area where an ink duty is in a predetermined range, the printing unit forms dots by forward movement in which the print head relatively moves in one direction of the main scan directions and backward movement in which the print head relatively moves in the direction opposite to the one direction so that a forward-moving dot occurrence ratio that is a ratio of forming the dots by the forward movement and a backward-moving dot occurrence ratio that is a ratio of forming the dots by the backward movement are gradually increased with a biased magnitude relation as the ink duty is increased.

According to the configuration of the printing apparatus, the forward-moving dot occurrence ratio and the backward-moving dot occurrence ratio are gradually increased in a biased magnitude relation as the ink duty is increased, so that the formed dots are biased to any one of the dots formed by the forward movement or the dots formed by the backward movement. Therefore, the difference in the dot forming timing in the sub scan direction in the main-scan-direction end portion of the printing medium can be reduced. Accordingly, non-uniformity in concentration occurring in the sub scan direction in the bidirectional printing is suppressed, so that deterioration in the quality of a printing image can be suppressed. In addition, the forward-moving dot occurrence ratio and the backward-moving dot occurrence ratio are not zero with respect to the ink duty that is in a predetermined range, and the forward-moving dot occurrence ratio and the backward-moving dot occurrence ratio are gradually increased as the ink duty is increased. Therefore, since the difference between the dot forming timings is not rapidly changed, the changing points are not noticeable, so that deterioration in the quality of a printing image can be suppressed.

Application Example 2

In the printing apparatus of Application Example 1, the halftone processing unit compares a dither mask constructed with a plurality of threshold values with the image data to generate the dot data, and the plurality of threshold values of the dither mask are set so that the forward-moving dot occurrence ratio and the backward-moving dot occurrence ratio are gradually increased with the biased magnitude relation in the printing area.

According to the configuration of the printing apparatus, the effects of Application Example 1 can be obtained by performing only the halftone process using the dither mask of which a plurality of threshold values are set so that the forward-moving dot occurrence ratio and the backward-moving dot occurrence ratio are gradually increased in a biased magnitude relation. Therefore, it is possible to simplify the process and increase the speed of the process.

Application Example 3

In the printing apparatus of Application Example 2, the plurality of threshold values of the dither mask are set so that dot dispersiveness of any one of the dots formed by the forward movement, the dots formed by the backward movement, and the entire dots formed by the forward movement and the backward movement can be secured.

According to the configuration of the printing apparatus, even in the case where the dots constituting an image are biased to any one of the dots formed by the forward movement and the dots formed by the backward movement, the dot dispersiveness can be secured, so that deterioration in the graininess of a printing image and deterioration in the quality of the printing image can be prevented.

In addition, the printing apparatus of Application Example 1 can also be adapted to the printing apparatuses of Application Examples 4 to 6.

Application Example 4

In the printing apparatus of Application Example 1, the halftone processing unit generates the dot data by an error diffusion method of quantizing the image data by comparing the image data with the predetermined threshold value while adding quantization errors of the image data to surrounding image data with a predetermined distribution ratio, so that the predetermined threshold value used to determine whether or not the dot is formed at any one of the dot forming position at which the dot is formed by the forward movement and the dot forming position at which the dot is formed by the backward movement in the printing area is relatively increased according to the dot forming position.

Application Example 5

In the printing apparatus of Application Example 1, the halftone processing unit generates the dot data by an error diffusion method of quantizing the image data by comparing the image data with the predetermined threshold value while adding quantization errors of the image data to surrounding image data with a predetermined distribution ratio, so that the quantization errors at the time of determining that the dots are formed in the printing area are added with a relatively high distribution ratio that is set to any one of the image data corresponding to the dot forming position at which the dots are formed by the forward movement and the image data corresponding to the dot forming position at which the dots are formed by the backward movement.

Application Example 6

In the printing apparatus of Application Example 1 or 5, the halftone processing unit generates the dot data by an error diffusion method of quantizing the image data by comparing the image data with the predetermined threshold value while adding quantization errors of the image data to surrounding image data with a predetermined distribution ratio, so that the quantization errors at the time of determining that the dots are not formed in the printing area are added with a relatively low distribution ratio that is set to any one of the image data corresponding to the dot forming position at which the dots are formed by the forward movement and the image data corresponding to the dot forming position at which the dots are formed by the backward movement.

Application Example 7

In the printing apparatus of any one of Application Examples 1 to 6, the printing unit at least controls ejection of a first ink having a predetermined ink color and a second ink having an ink color different from that of the first ink, so that the forward-moving dot occurrence ratio is larger than the backward-moving dot occurrence ratio with respect to the first ink, and so that the backward-moving dot occurrence ratio is larger than the forward-moving dot occurrence ratio with respect to the second ink.

According to the configuration of the printing apparatus, the dots formed by the forward movement can be easily formed by the first ink, and the dots formed by the backward movement can be easily formed by the second ink. Therefore, the time interval where the ink is ejected between the first and second inks can be increased, so that the ink cannot be easily smeared. Accordingly, quality of a printing image can be improved.

In addition, the invention can be implemented as the following aspects: a dither mask of Application Example 8; a program of Application Example 9; and a printing method of Application Example 10.

Application Example 8

According to another aspect of the invention, there is provided a dither mask that is constructed with a plurality of threshold values to be used for a halftone process for performing printing by moving a print head in main scan directions and sub scan directions relative to a printing medium, wherein, in a printing area where an ink duty is in a predetermined range, dots are formed by forward movement in which the print head relatively moves in one direction of the main scan directions and backward movement in which the print head relatively moves in the direction opposite to the one direction, and wherein the plurality of threshold values are set so that a forward-moving dot occurrence ratio that is a ratio of forming the dots by the forward movement and a backward-moving dot occurrence ratio that is a ratio of forming the dots by the backward movement are gradually increased with a biased magnitude relation as the ink duty is increased.

Application Example 9

According to another aspect of the invention, there is provided a computer program that is used to perform printing by moving a print head in main scan directions and sub scan directions relative to a printing medium, the computer program causing a computer to execute a function of performing printing by controlling ejection of ink from the print head, by forming dots, in a printing area where an ink duty is in a predetermined range, by forward movement in which the print head relatively moves in one direction of the main scan directions and backward movement in which the print head relatively moves in the direction opposite to the one direction so that a forward-moving dot occurrence ratio that is a ratio of forming the dots by the forward movement and a backward-moving dot occurrence ratio that is a ratio of forming the dots by the backward movement are gradually increased with a biased magnitude relation as the ink duty is increased.

Application Example 10

According to another aspect of the invention, there is provided a printing method of performing printing by moving a print head in main scan directions and sub scan directions relative to a printing medium, wherein printing is performed by controlling ejection of ink from the print head, by forming dots, in a printing area where an ink duty is in a predetermined range, by forward movement in which the print head relatively moves in one direction of the main scan directions and backward movement in which the print head relatively moves in the direction opposite to the one direction so that a forward-moving dot occurrence ratio that is a ratio of forming the dots by the forward movement and a backward-moving dot occurrence ratio that is a ratio of forming the dots by the backward movement are gradually increased with a biased magnitude relation as the ink duty is increased.

BRIEF DESCRIPTION OF THE DRAWINGS

The invention will be described with reference to the accompanying drawings, wherein like numbers reference like elements.

FIGS. 4A to 4C are views for explaining a non-uniformity in concentration in bidirectional printing.

FIGS. 5A to 5C are views for explaining a non-uniformity in concentration in bidirectional printing.

FIGS. 6A to 6D are views for explaining a non-uniformity in color in bidirectional printing.

FIGS. 10A to 10C are views showing matrices representing a main scan direction pattern in a printing area of a printer.

FIGS. 11A to 11C are views for explaining the entire dither mask and divided dither masks in a grouping process.

FIG. 13 is a view for explaining an aspect of an entire dither mask in which dots are formed at eight pixels corresponding to elements storing threshold values corresponding to dots having the first to eighth easiness of formation.

FIG. 14 is a view for explaining a dot density matrix quantitatively representing a dot density.

FIG. 15 is a view for explaining an example of a low pass filter.

FIG. 16 is a view for explaining an aspect where the same dot density matrices are disposed around the dot density matrix in order to perform calculation on peripheral portions of the dot density matrix.

FIG. 17 is a view for explaining a result of a filtering process on a dot density matrix of the entire dither mask.

FIG. 18 is a view for explaining a dot pattern that is obtained by extracting only dots corresponding to pixels included in a divided dither mask.

FIG. 19 is a view for explaining a matrix that stores determined integrated evaluation values.

FIG. 20 is a view for explaining a matrix that is obtained by extracting only elements included in a divided dither mask from an integrated evaluation value matrix.

DESCRIPTION OF EXEMPLARY EMBODIMENTS

Exemplary embodiments of the invention will be described in the following order.

A. Embodiments
A-1. Configuration of Apparatus
A-2. Printing Process
A-3. Problems of Bidirectional Printing
A-4. Dot Occurrence Characteristics of Dither Mask 62
A-5. Generation Method for Dither Mask 62
A-6. Effects of the Invention
B. Modified Examples

A. EMBODIMENTS

A-1. Configuration of Apparatus

Figure 1:
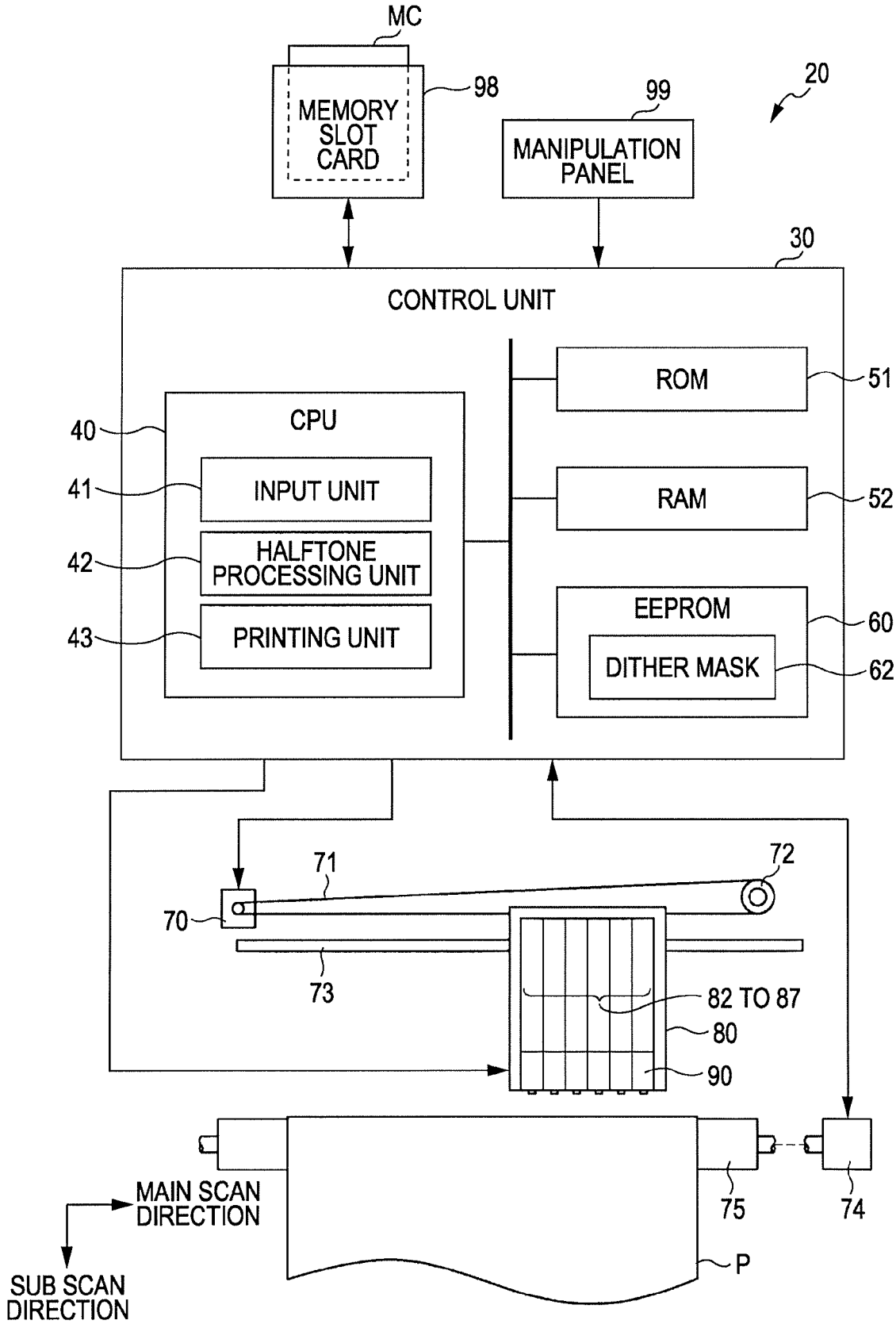
FIG. 1 is a schematic view showing a configuration of a printer according to an embodiment of the invention.

FIG. 1 is a schematic view showing a configuration of a printer 20 according to an embodiment of the invention. The printer 20 is an ink jet printer. As shown in the figure, the printer 20 includes a mechanism that transports a printing medium P by using a sheet transporting motor 74, a mechanism that reciprocatingly moves a carriage 80 in an axis direction of a platen 75 by using a carriage motor 70, a mechanism that drives a print head 90 mounted on the carriage 80 to perform ink ejection and dot forming, and a control unit 30 that controls exchanging signals with the sheet transporting motor 74, the carriage motor 70, and the print head 90.

The mechanism that reciprocatingly moves the carriage 80 in the axis direction of the platen 75 includes a sling shaft 73 that is disposed in parallel to the axis of the platen 75 to slidably support the carriage 80 and a pulley 72, where an endless driving belt 71 is suspended between the pulley 72 and the carriage motor 70.

Color ink cartridges 82 to 87 for color inks, that contain cyan ink C, magenta ink M, yellow ink Y, black ink K, light cyan ink Lc, and light magenta ink Lm, respectively, are mounted on the carriage 80. Nozzle columns corresponding to the aforementioned color inks are formed in the print head 90 in the lower portion of the carriage 80. If the ink cartridges 82 to 87 are mounted on the upper portion of the carriage 80, ink can be supplied from each ink cartridge to the print head 90.

The control unit 30 includes a CPU 40, a ROM 51, a RAM 52, and an EEPROM 60 that are connected to each other via a bus. The control unit 30 expands programs stored in the ROM 51 or the EEPROM 60 on the RAM 52 to execute the programs. The control unit 30 has functions as an input unit 41, a halftone processing unit 42, and a printing unit 43 as well as a controller for controlling the entire operations of the printer 20. These functions will be described later in detail.

A dither mask 62 is stored in the EEPROM 60. The dither mask 62 is used for a halftone process according to a systematic dither method. In the embodiments, the dither mask 62 has a characteristic in that dot dispersiveness is excellent.

A memory card slot 91 is connected to the control unit 30, so that image data ORG that are read from a memory card MC inserted into the memory card slot 91 can be input to the control unit 30. In the embodiment, the image data ORG that are input from the memory card MC are data that have three color components, that is, red (R), green (G), and blue (B).

In the printer 20 having the above hardware configuration, the print head 90 is reciprocatingly moved in a main scan direction with respect to the printing medium P by driving the carriage motor 70, and the printing medium P is moved in a sub scan direction by driving the sheet transporting motor 74. The control unit 30 forms ink dots of suitable colors at suitable positions of the printing medium P by driving nozzles at suitable timings based on printing data in coincidence with the reciprocating movement (main scan) of the carriage 80 and the sheet transporting movement (sub scan) of the printing medium P. Accordingly, the printer 20 can print an input color image on the printing medium P.

Figure 2:
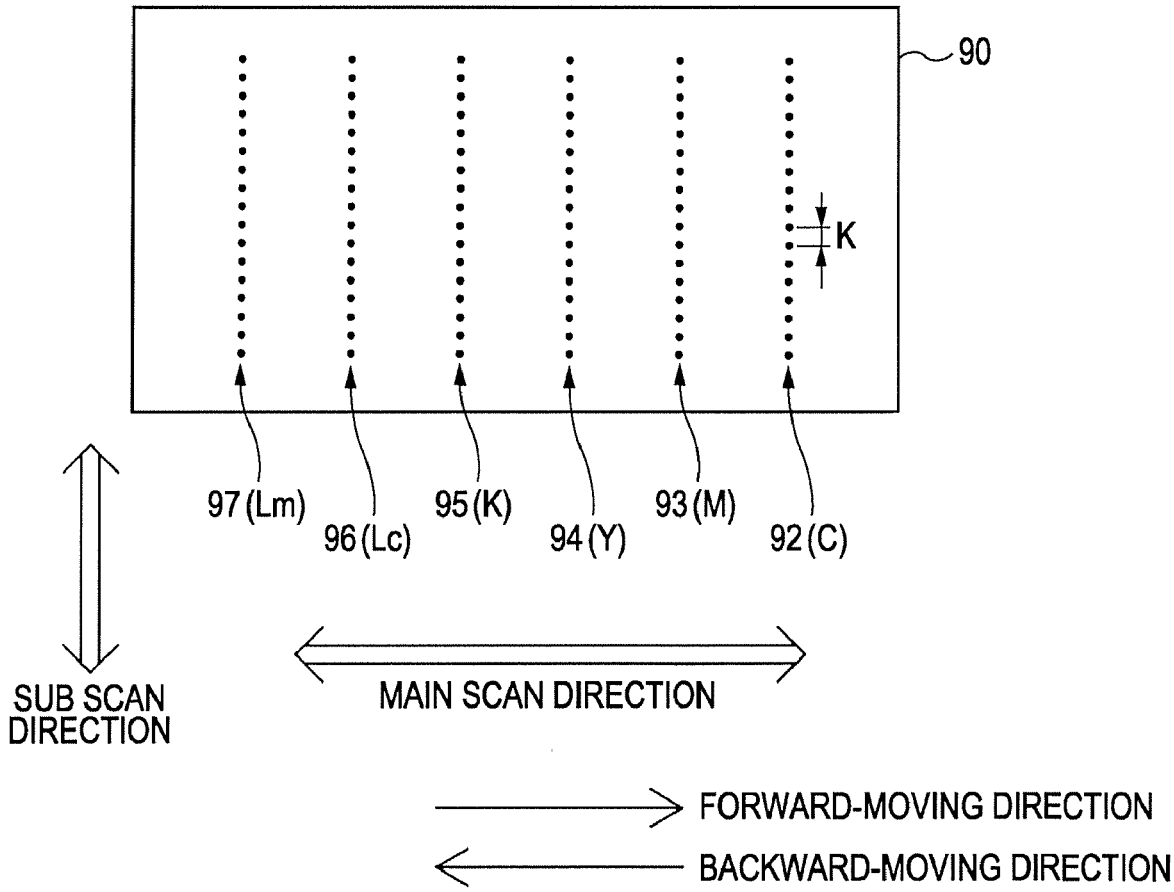
FIG. 2 is a view for explaining a nozzle arrangement of a print head.

The aforementioned print head 90 is shown in detail in FIG. 2. The figure schematically shows a bottom surface of the print head 90 (a surface facing the printing medium P. As shown in the figure, the print head 90 includes nozzle columns 92 to 97, in which a plurality of nozzles are formed to be aligned in the sub scan direction. In the embodiment, each nozzle column includes 30 nozzles that are aligned at a nozzle pitch K. The nozzle columns 92 to 97 correspond to the ink colors of the cartridges mounted on the carriage 80 to eject the cyan ink C, the magenta ink M, the yellow ink Y, the black ink K, the light cyan ink Lc, and the light magenta ink Lm, respectively. In addition, although the nozzle column corresponding to each ink color is configured with nozzles that are aligned in one column in the embodiment, the nozzle arrangement in one nozzle column is not particularly limited. For example, a plurality of columns of nozzles may be aligned with respect to one ink color. Furthermore, a plurality of columns of nozzles may be configured to be in a zigzag shape.

A-2. Printing Process

Figure 3:
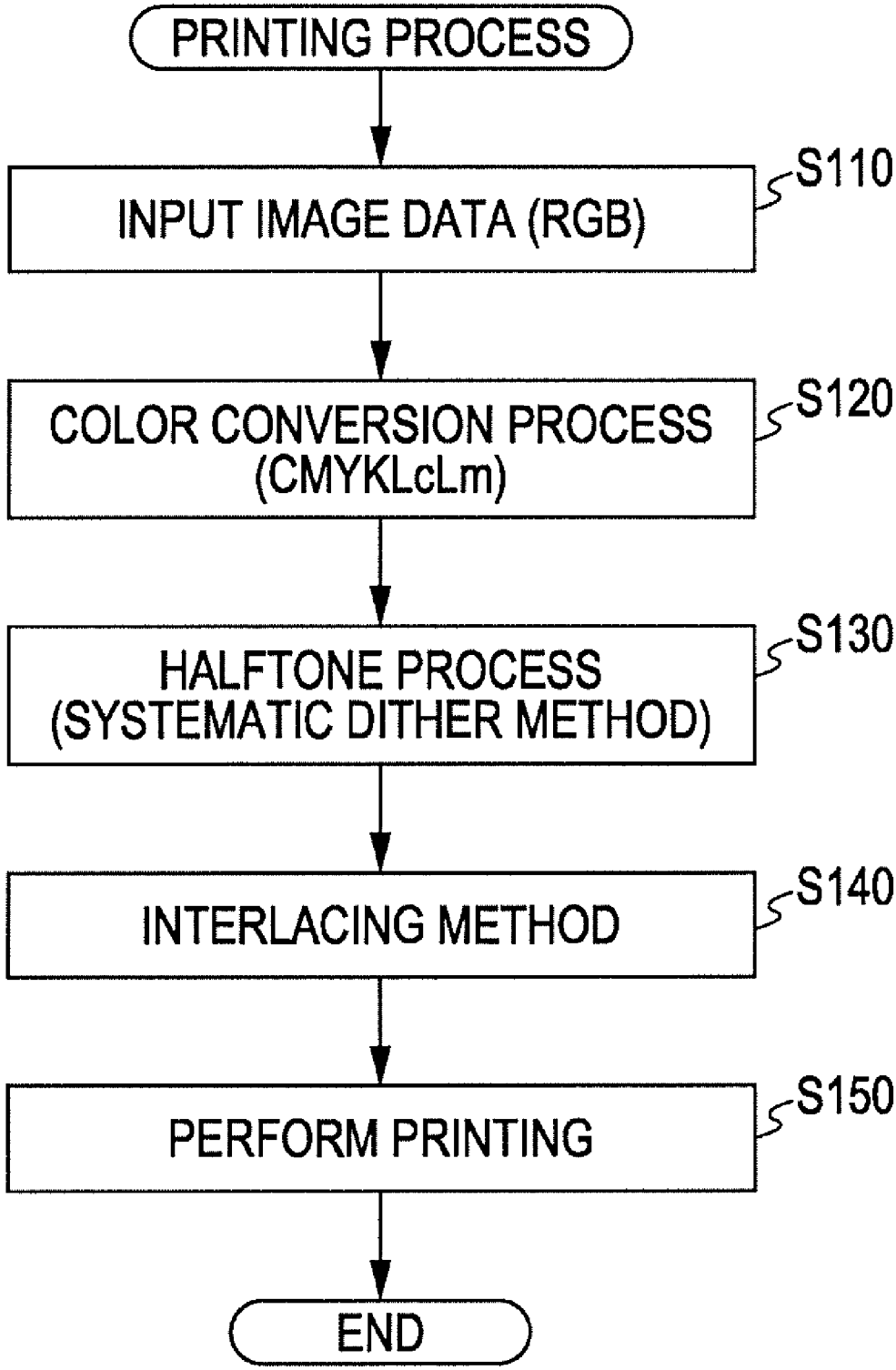
FIG. 3 is a flowchart showing a procedure of a printing process of a printer.

A printing process of the printer 20 is described. FIG. 3 is a flowchart showing the printing process according to the embodiment. When a user performs a printing instructing manipulation for a predetermined image stored in the memory card MC by using a manipulation panel 99, the printing process starts. If the printing process starts, the CPU 40 first allows the input unit 41 to perform reading image data ORG having an RGB format that are the printing object from the memory card MC through the memory slot 98 and inputting the image data ORG (Step S110).

If the image data ORG is input, the CPU 40 color-converts the RGB format of the image data ORG to a CMYKLcLm format with reference to a lookup table (not shown) stored in the EEPROM 60 (Step S120).

If the color conversion process is performed, the CPU 40 performs a halftone process of converting the image data to dot-ON/OFF data of each color by using the dither mask 62 through a systematic dithering method as a process of the halftone processing unit 42 (Step S130). Since the systematic dithering method is a well-know technique, detailed description thereof is omitted. In brief, in the systematic dithering method, a recording rate corresponding to gradation data of an objective pixel and a threshold value in a dither mask corresponding to a position of the objective pixel are compared to each other. If the recording rate is larger, a dot is determined to be formed at the pixel; and if the recording rate is smaller, no dot is determined to be formed. The dither mask 62 used herein will be described later in detail.

If the halftone process is performed, the CPU 40 performs an interlacing process of changing alignment in dot pattern data that is printed in units of one main scan in accordance with the nozzle arrangement or sheet transporting amount of the printer 20 (Step S140).

If the interlacing process is performed, the CPU 40 performs printing by driving the print head 90, the carriage motor 70, and the motor 74 as a process of the printing unit 43 (Step S150). In addition, in the embodiment, the bidirectional printing is performed. In other words, the print head 90 performs the reciprocating movement from the left end of the printing medium P to the right end thereof in the main scan direction to eject ink by the forward movement (in the embodiment, in the direction from the left end to the right end) of the reciprocating movement and the backward movement (in the embodiment, in the direction from the right end to the left end).

A-3. Problems of Bidirectional Printing

The problems that are caused by the bidirectional printing performed in the serial ink jet printer are described.

A-3-1. Non-Uniformity in Concentration Caused by a Difference in Dot Forming Timing FIGS. 4A to 4C and FIGS. 5A to 5C are views showing aspects in which dots are formed by the printer 20. Although FIGS. 5A to 5C are views continuously connected to FIGS. 4A to 4C, due to the limitation in the drawing area, FIGS. 4A to 4C and FIGS. 5A to 5C are divided into two figures. Herein, the aspect in which the dots are formed by the nozzle column 92 is representatively described. However, the same description can be made with respect to the other nozzle columns. In FIGS. 4A and 5A, the aspect in which the nozzle column 92 is moved in the sub scan direction every time of the main scan is shown. For the convenience of description, the nozzles are denoted by reference numerals 0 to 29. In the embodiment, as an aspect of control of driving the print head 90, an overlap number is set to "2", a nozzle pitch is set to "2", and a sheet transporting amount is set to "15". In addition, the bidirectional printing in which ink is ejected in both of the forward and backward movements of the print head 90 is designed to be performed. The overlap number denotes the number of main scan needed to entirely fill dots into one raster formed in the main scan direction (horizontal direction). In addition, the nozzle pitch denotes the number of dots between centers of adjacent nozzles in the sub scan direction, that is, a number that is obtained by adding the value of 1 to the number of rasters (dots) existing between two adjacent nozzles. In addition, the sheet transporting amount denotes an amount (number of rasters) of transporting the print head 90 in the sub scan direction during one main scan.

As shown in FIGS. 4A and 5A, in the embodiment, since the sheet transporting amount is set to "15", the print head 90 is moved by 15 rasters in the sub scan direction every time of the main scan. In addition, the nozzle position (in the main scan direction) shown therein corresponds to a position of a main scan number (refer to a table in the upper portion of FIG. 4A) indicating which order the main scan has relatively. For example, the position of the nozzle column shown in the leftmost side corresponds to the main scan number "−3". In addition, the main scan number is represented by a relative number with respect to the fourth main scan, shown in the figure, that is set to a reference main scan (0-th main scan).

In FIGS. 4B and 5B, it is represented by the main scan number which order of main scans each of dots that are to be formed on the printing medium is formed in. Each lattice shown in FIGS. 4B and 5B represents an odd-numbered dot or an even-numbered dot in each raster, and the value in the lattice corresponds to the main scan number shown in the upper portions of FIGS. 4A and 5A. In other words, it can be understood from FIGS. 4B and 5B that, in the uppermost raster, the odd-numbered dots are formed by the 0-th main scan, and the even-numbered dots are formed by the (−2)-th main scan.

As shown in FIGS. 4B and 5B, in the embodiment, if a 2×2 localized area (hereinafter, referred to as a localized area) is focused on, the main scan numbers in the two uppermost rasters are "0", "−1", "−2", and "−3" in the order of the upper left, lower left, upper right, and lower right directions. In other words, in the localized area, the dots are filled in the order of the lower right, upper right, lower left, and upper left directions. This order is referred to as a "filling order". With respect to the size of the localized area, the size in the horizontal direction (main scan direction) is equal to the overlap number (in the embodiment, "2"), and the size in the vertical direction (sub scan direction) is equal to the nozzle pitch (in the embodiment, "2"). In FIGS. 4B and 5B, the lattices are represented to be partitioned by solid lines corresponding to the localized areas. The filling order has a property that the filling order is changed every time that the print head 90 is moved in the sub scan direction (that is, every time of performing the main scan). Therefore, in the embodiment, if the filling order is changed four times, the filling order returns to the initial filling order. The unit number of repetition of the filling order is a product of the nozzle pitch and the overlap number. In addition, in FIGS. 4B and 5B, the main scan number of the position where the filling order is changed is represented in an inversion manner. The setting of the filling order is performed by the aforementioned Step S140 of the printing process.

FIGS. 4C and 5C show nozzle patterns representing which nozzles the dots of the position on the printing medium are formed by. The value in each lattice corresponds to the nozzle number shown in FIGS. 4A and 5A. In addition, for the convenience of description, dot column numbers are listed in the upper sides of the figures, and dot row numbers are listed in the left sides of the figures. Referring to FIGS. 4C and 5C and FIGS. 4B and 5B, it can be understood that, for example, in the uppermost raster in the figure, the odd-numbered dots are formed by the 0-th nozzle in the 0-th main scan, and the even-numbered dots are formed by the 15-th nozzle in the (−2)-th main scan.

In the nozzle pattern, in the same raster (main scan direction), the even-ordered column dot forming positions and the odd-ordered column dot forming positions correspond to the same respective nozzle numbers. In addition, in the sub scan direction, nozzle numbers are repeated in unit of the first to 60-th rows. In other words, the nozzle pattern of the printer 20 is configured by repeating the minimum repetition unit RU, which is constructed with the first column, the second column, and the first row to the 60-th row, in the main scan direction and the sub scan direction. The periodicity of the nozzle pattern is associated with the repetition of the aforementioned filling order. In the main scan direction, the repetition occurs in units of the overlap number, and in the sub scan direction, the repetition occurs in units of a product of the sheet transporting amount and the repetition unit number of the aforementioned filling order.

In addition, in both flanks of FIGS. 4C and 5C, formation timings of the dots in the both ends of the printing medium P are shown. Herein, due to the limitation in the drawing area, a with of the sheet is divided into 16 rows of dots. If the aforementioned localized area is focused on, in the localized area in the left-end of the printing medium P, for example, in the localized area from the position of the first row and the first column to the position of the second row and the second column in the left-end of the printing medium P, in the (−3)-th main scan (in the right direction), the first dot are formed by the nozzle of nozzle number 23. Next, in the (−2)-th main scan (in the left direction), the second dot is formed by the nozzle of nozzle number 15. The dot is formed as the reciprocating movement time of the print head 90 elapses after the first dot is formed. Since the dot is formed as a relatively long time elapses after the preceding dot is formed, the dot is referred to as a long dot L in the application.

In addition, in the (−1)-th main scan (in the right direction), the third dot is formed by the nozzle of nozzle number 8. The dot is formed at the time when the print head 90 returns to the left end of the printing medium P after the second dot is formed. Since the dot is formed as a relatively short time elapses after the preceding dot is formed, the dot is referred to as a short dot S in the application.

Next, in the 0-th main scan (in the left direction), the last dot is formed by the nozzle of nozzle number 0. The dot is the long dot L. Although the description thereof is omitted, similarly, the long dots L and the short dot S are also formed in the other localized areas in both ends of the printing medium P. In FIGS. 4C and 5C, the dot forming positions where the long dots L are formed are indicated by hatching, and the dot forming positions where the short dots S are formed are indicated by inversion.

As described above, in the localized area from the position of the first row and the first column to the position of the second row and the second column, after the first dot is formed, the second to fourth dots are formed in the order of the long dot L, the short dot S, and the long dot L. In FIGS. 4C and 5C, the dots are represented by "LSL" as the dot forming timing of the left flank of the nozzle pattern.

On the other hand, in the localized area of the right end of the printing medium P, for example, in the localized area from the first row and the 15-th column and to the second row and the 16-th column, the dots are formed in the order of the short dot S, the long dot L, and the short dot S, that is, the opposite order of the right end. In FIGS. 4C and 5C, the dots are represented by "SLS" as the dot forming timing of the right flank of the nozzle pattern.

With respect to the dot forming timings, as shown in the dot forming timings of FIGS. 4C and 5C, "LSL" and "SLS" are changed in the sub scan direction every dot forming position where the print head 90 is moved in the sub scan direction. For example, in the left end of the printing medium P, the dot forming timing in the localized area including the dot forming position from the first row and the first column to the dot forming position of the 14-th row and the second column is "LSL", but dot forming timing in the localized area including the dot forming position from the 15-th row and the first column to the dot forming position of the 30-th row and the second column is "SLS".

In this manner, in the bidirectional printing, the dot forming timing is changed in the sub scan direction every time that the print head 90 is relatively moved. The difference in the dot forming timing causes the difference in the easy smearing of ink and the non-uniformity in concentration, so that a striped shape occurs in the sub scan direction of the printing image every transporting amount of the print head 90. The problems are particularly dominant in the case of a wide paper printer in which a long time is needed for one reciprocating movement of the print head 90.

A-3-2. Non-Uniformity in Color Caused by a Difference in Dot Forming Order Between Ink Colors FIG. 6 shows the main scan direction of the print head 90, which forms dots in the localized area, in a manner of a time sequence. As described with reference to FIG. 4C, the four dots in the localized area from the position of the first row and the first column to the position of the second row and the second column are formed by the main scan in the order of the right direction, the left direction, the right direction, and the left direction. In FIG. 6C, the order are represented by the main scan direction order "→←→←" in the right flank of the nozzle pattern. Similarly to the aforementioned dot forming timing, the main scan direction order is changed between the order "→←→←" and the order "←→←→" in the sub scan direction every dot forming position where the print head 90 is moved in the sub scan direction. In addition, the nozzle patterns after the 38-th row are omitted.

Herein, as shown in FIG. 2, since the nozzle columns 92 to 97 corresponding to the color inks are aligned in the sub scan direction, the difference in the main scan direction of the print head 90 causes the difference in the ejection order of the color inks. In other words, in the forward movement (in the right direction in FIG. 2) of the print head 90, the color inks are ejected on the printing medium P in the order of the cyan ink C, the magenta ink M, the yellow ink Y, the black ink K, the light cyan ink Lc, and the light magenta ink Lm; and in the backward movement (in the left direction in FIG. 2) of the print head 90, the color inks are ejected in the order of the light magenta ink Lm, the light cyan ink Lc, the black ink K, the yellow ink Y, the magenta ink M, and the cyan ink C. The difference in the ejection order of the color inks causes the difference in color tone of dots formed on the printing medium P. As described above, the difference in color tone is also caused by the change in the order of main scan directions, where the dots are formed in a predetermined area, according to the dot forming positions, so that non-uniformity in color can be formed at the changing position.

A-4. Dot Occurrence Characteristics of Dither Mask 62

Figure 7:
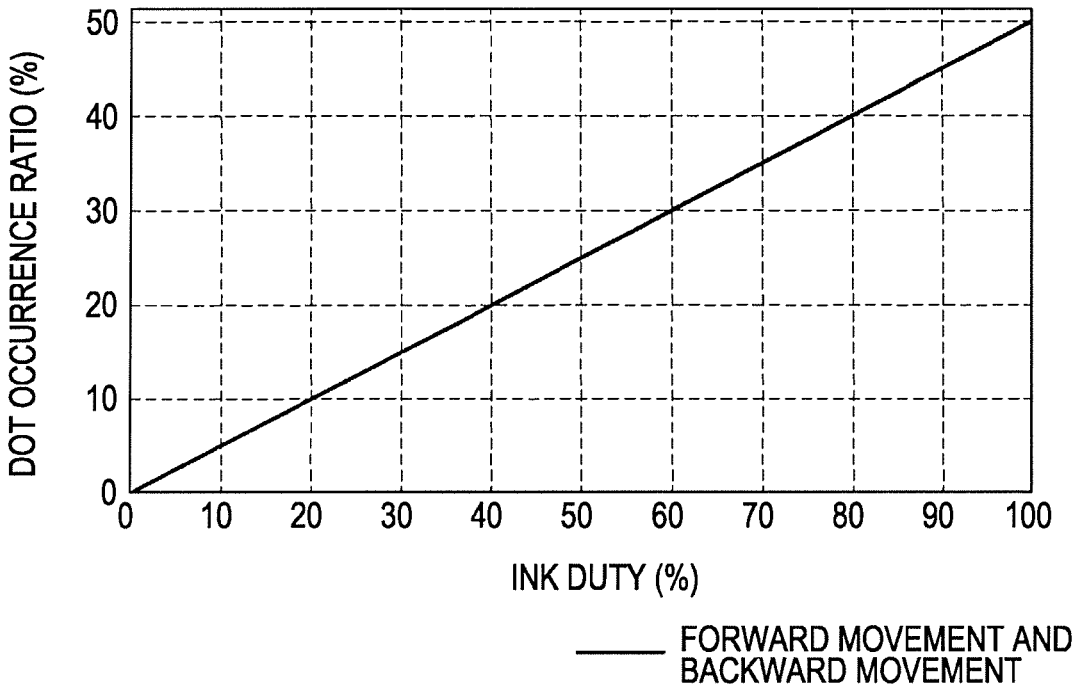
FIG. 7 is a view for explaining dot occurrence characteristics of a dither mask in the related art.

Before the dither mask 62 used for the halftone process of the printer 20 according to the embodiment is described, the dot occurrence characteristics of the dither mask in the related art are described. FIG. 7 shows the dot occurrence characteristics of the dither mask in the related art. As shown in the figure, each threshold value of the dither mask in the related art is set so that the dot occurrence ratios of the forward movement and backward movement of the print head 90 are equal to each other in the printing area having all ink duties. The dot occurrence ratio is an occupying ratio of dots formed by the forward movement or the backward movement to all the dots corresponding to a predetermined value in the case where the printing is performed with an ink duty having the predetermined value. In the example, for example, in the case where the ink duty is 50%, the forward-moving dot occurrence ratio and the backward-moving dot occurrence ratio are 25%. Since the dot occurrence ratios of the forward movement and the backward movement are equal to each other, in the case where the difference between the two dot occurrence ratios is rapidly changed according to the ink duty, the difference in the position of the dot caused by a difference in fine scan characteristics such as main scan speeds between the forward movement and the backward movement can be prevented from being easily noticeable.

Figure 8:
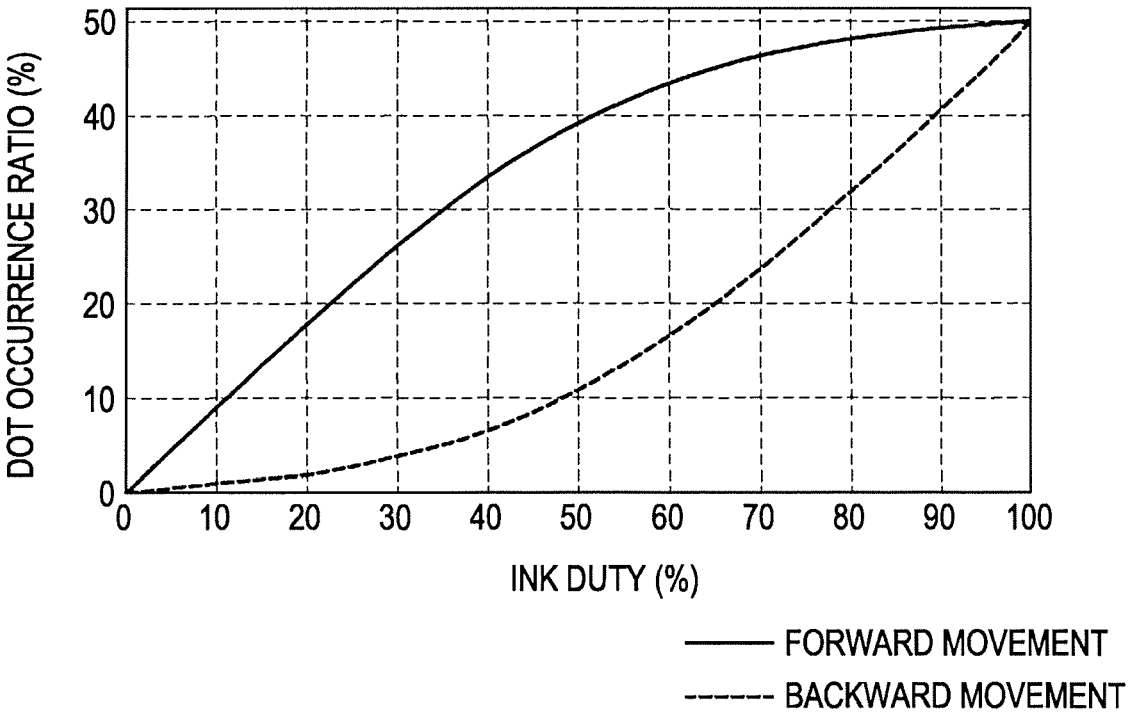
FIG. 8 is a view for explaining dot occurrence characteristics of a dither mask used for a printer.

On the other hand, the dot occurrence characteristics of the dither mask 62 according to the embodiment are shown in FIG. 8. AS shown in the figure, with respect to the dither mask 62 according to the embodiment, the dots are formed by the forward movement and the backward movement in the printing area having all the duties (however, the case of a single dot is reasonably excluded). In addition, each threshold value of the dither mask 62 is set so that the forward-moving dot occurrence ratio and the backward-moving dot occurrence ratio are smoothly and gradually increased with a biased magnitude relation (however, the case where the ink duty is 0% and 100% is reasonably excluded).

A-5. Generation Method for Dither Mask 62

Figure 9:
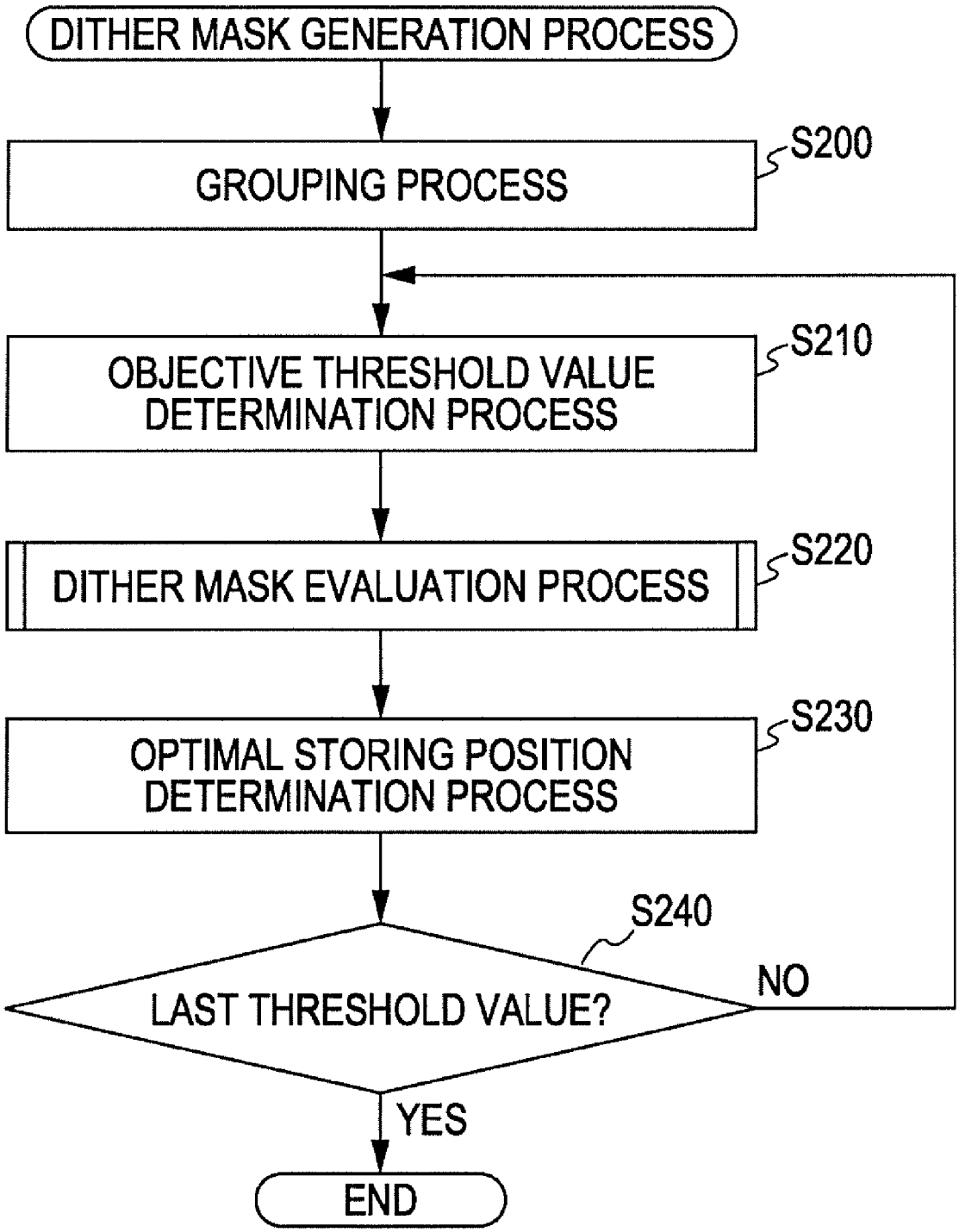
FIG. 9 is a flowchart showing a procedure of a dither mask generation process.

A-5-1. Generation Method for Dither Mask 62 According to First Embodiment A generation method for the aforementioned dither mask 62 according to a first embodiment is described as follows. FIG. 9 is a flowchart showing a procedure of the generation method for the dither mask according to the first embodiment. In addition, in this example, a small dither mask having 8 rows and 8 columns is to be generated for the convenience of description.

Firstly, the generation of the dither mask 62 starts with performing a grouping process (Step S200). The grouping process is a process of dividing the elements of the to-be-generated entire dither mask M into a divided dither mask M1 constructed with elements applied to the dot forming positions formed by the forward movement of the print head 90 and a divided dither mask M2 constructed with elements applied to the dot forming positions formed by the backward movement of the print head 90. The main scan direction pattern indicating which direction the dots are formed in by the main scan in the dot forming area having the same size as the dither mask is shown in FIG. 10A. In the drawings, "→" denotes the forward movement, and "←" denotes the backward movement. In this example, as shown in the figure, the rasters where all the dots are formed by the forward movement and the rasters where all the dots are formed by the backward movement are configured to be alternately repeated. The main scan direction patterns correspond to the nozzle patterns shown in FIGS. 4 and 5.

The elements of the entire dither mask M based on the main scan direction pattern shown in FIG. 10A are shown in FIG. 11A. Numerals written in the elements indicate which of the divided dither masks the elements are divided into. The value 1 denotes an element of the divided dither mask M1 corresponding to the forward movement, and the value 2 denotes an element of the divided dither mask M2 corresponding to the backward movement. For example, in the entire dither mask M, the element of the first row and the first column is included in the divided dither mask M1, the element of the second row and the first column is included in the divided dither mask M2. The entire dither mask M is divided into the divided dither mask M1 and the divided dither mask M2, and the divided dither masks M1 and M2 can be displayed as shown in FIGS. 11B and 11C. The elements marked by the value 1 or the value 2 are originated from the entire dither mask M. The threshold values stored in the elements are determined by the method described later. The elements marked with blanks are elements where no dot is formed irrespective of the input gradation value.

In addition, in the embodiment, the main scan direction pattern as a basis of the grouping process is the pattern shown in FIG. 10A. However, the main scan direction pattern is not limited to a specific one. For example, the patterns shown in FIGS. 10B and 10C may be used.

Next, if the grouping process is performed, an objective threshold value determination process is performed (Step S210). The objective threshold value determination process is a process of determining a threshold value, that is, the object of determination which one of the positions of the storage elements of the entire dither mask M and divided dither masks M1 and M2 a predetermined threshold value is to be stored in. In the embodiment, the threshold value is determined by selecting sequentially from the threshold value having a relatively small value (for example, the value 1), that is, the threshold value having the value corresponding to the dot that is easy to form. The threshold value set herein is also referred to as an objective threshold value.

Next, If the objective threshold value determination process is performed, a dither mask evaluation process is performed (Step S220). The dither mask evaluation process is a process of numericalizing the dot dispersiveness of the dither mask based on a predetermined evaluation function. In the embodiment, the evaluation function represents the uniformity of the dot density distribution. In other words, the evaluation standard is whether or not a plurality of the dots formed at the pixels corresponding to the elements of the dither mask are uniformly formed at any gradation values. However, in the embodiment, only the entire dither mask M is not taken into consideration, but the two divided dither masks M1 and M2 are taken into consideration for the evaluation. This feature will be described later in detail.

Figure 12:
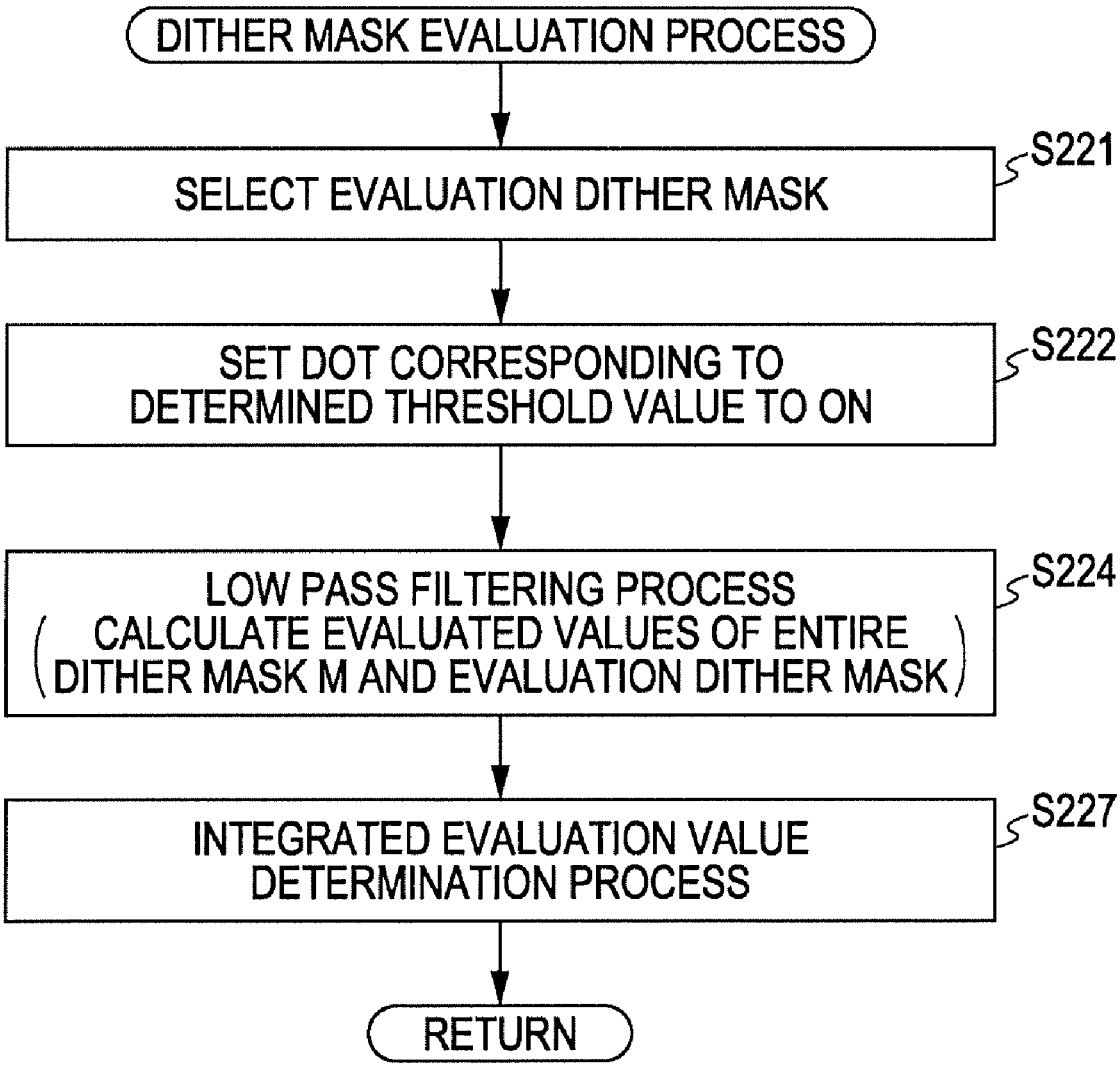
FIG. 12 is a flowchart showing a procedure of a dither mask evaluation process according to a first embodiment in a dither mask generation process.

FIG. 12 is a flowchart showing a flow of the dither mask evaluation process. In the process, firstly, an evaluation dither mask is selected (Step S221). The evaluation dither mask is a divided dither mask in which the objective threshold value is to be stored at the time of determining which one of the storage elements the threshold value is to be stored in among the divided dither mask M1 and the divided dither mask M2. In the embodiment, the selection of the evaluation dither mask is provided since the optimal storage position of the objective threshold value is determined by taking into consideration the evaluation dither mask and the entire dither mask M.

The evaluation dither mask is selected from the divided dither masks M1 and M2 by a predetermined procedure every time that the objective threshold value is determined in Step S210. In the embodiment, in order to approximate the dot occurrence characteristics shown in FIG. 8, the evaluation dither mask may be selected according to the following procedure.

(1) In the case where the M-th threshold value (that is, the threshold value corresponding to the dot having the M-th easiness of formation) from the small value among N threshold values is set to the objective threshold value, firstly, the forward-moving and backward-moving dot occurrence ratios in the case of the ink duty having (M/N) % are obtained from the graph shown in FIG. 8. The dot occurrence ratios are ideal dot occurrence ratios.

(2) The forward-moving and backward-moving dot occurrence ratios of the case where the objective threshold value is stored in the divided dither mask M1 (that is, in the case where the dot having the M-th easiness of formation is formed by the forward movement) and of the case where the objective threshold value is stored in the divided dither mask M2 (that is, the dot having the M-th easiness of formation is formed by the backward movement) are obtained.

(3) The closeness of the dot occurrence ratio obtained in (2) to the ideal dot occurrence ratio is the determination whether the objective threshold value is stored in the divided dither mask M1 or the objective threshold value is stored in the divided dither mask M2. As a result, the divided dither mask that is determined to be closer is selected as an evaluation dither mask.

Next, if the evaluation dither mask is selected, the dot corresponding to the determination-completed threshold value is set to ON (Step S222). The determination-completed threshold value denotes a threshold value in the case where the storage element is determined. In the embodiment, as described above, since the threshold value is selected in the order starting from the threshold value corresponding to the dot having the highest easiness of formation, if a dot is formed at the objective threshold value, the dot is necessarily formed at the pixel corresponding to the element storing the determination-completed threshold values. On the contrary, in the minimum input gradation value where the dot is formed at the objective threshold value, no dot is formed at the pixel corresponding to the elements other than the elements storing the determination-completed threshold values.

FIG. 13 is a view for explaining an aspect of the entire dither mask M in which dots are formed at eight pixels corresponding to elements of the entire dither mask M storing threshold values corresponding to dots having the first to eighth easiness of formation. The dot pattern is used to determine which pixel the 9-th dot is formed at. In other words, the dot pattern is used to determine which storage element the objective threshold value corresponding to the dot having the 9-th easiness of formation is stored. In the determination of the storage elements according to the embodiment, the positions of the storage element are determined so that the objective threshold values are stored in the elements corresponding to the pixels where the dots are sparsely formed. This is because the evaluation standard is whether or not a plurality of dots formed at the pixels corresponding to the elements of the dither mask are uniformly formed at any gradation value.

FIG. 14 is a view for explaining a matrix that is a numericalization of a state (refer to FIG. 13) where dots are formed at the aforementioned 8 pixels, that is, a dot density matrix quantitatively representing a dot density. Numeral 0 denotes that no dot is formed, and numeral 1 denotes that a dot is formed.

Next, if the dot corresponding to the determination-completed threshold value is set to ON, a low pass filtering process is performed on the dot density matrix (Step S224). The low pass filtering process is a process of extracting low frequency components from the aforementioned dot density matrix. The low pass filtering process is performed on the dot density matrices of the entire dither mask M and evaluation dither mask. The extraction of the low frequency components is performed in order to optimize the dither mask by taking into consideration human visual sensitivity characteristics that the sensitivity is relatively high in a low frequency range.

FIG. 15 is a view for explaining a low pass filtering process according to the embodiment. In the embodiment, since the result of the filtering process is used for only the magnitude comparison of dot density, normalization of the low pass filtering cannot be performed. As shown in FIG. 16, in the filtering process, the same dot density matrices are disposed so as to perform calculation of peripheral portions of the dot density matrix.

FIG. 17 is a view for explaining the result of the low pass filtering performed on the dot density matrix of the entire dither mask M (refer to FIG. 14). Numbers in the elements denote the entire evaluation values. The entire evaluation value denotes an evaluation value of the dot density distribution in the entire dither mask M of which storage elements for the 8 threshold values are determined under the assumption that the 9-th dot is formed at the position corresponding to the elements. A large number denotes a high dot density, and a small number denotes a low dot density, in which the dots are sparsely distributed.

The low pass filtering process is performed on the dot density matrix of the evaluation dither mask as well as the dot density matrix of the entire dither mask M. In the embodiment, the 9-th selected objective threshold value is assumed to be selected together with the divided dither mask M1 in the above Step S221. In addition, 6 objective threshold values among the 8 objective threshold values are assumed to be selected together with the divided dither mask M1 in the above Step S221. In other words, as shown in FIG. 18, the aforementioned low pass filtering process is performed by using the dot density matrix on the dot pattern that is formed by extracting only the dots corresponding to the pixels included in the divided dither mask M1. The result of the low pass filtering process performed on the obtained evaluation dither mask is referred to as a group evaluation value. Herein, the obtained group evaluation value denotes the evaluation value of each element under the assumption that the 7-th dot is formed in the divided dither mask M1 where the storage elements of 6 threshold values are determined. The calculated entire evaluation value and group evaluation value are used to determine the integrated evaluation value described later.

Next, if the low pass filtering process for the dot density matrixes of the entire dither mask M and evaluation dither mask is performed, an integrated evaluation value determination process is performed based on the result of the low pass filtering process (Step S227). In the integrated evaluation value determination process, the determination is made by multiplying predetermined weighting factors to the entire evaluation value and the group evaluation value and performing addition. In the embodiment, as an example, the weighting factors of the entire evaluation value and group evaluation value are set to "4" and "1", respectively.

FIG. 19 is a view explaining a matrix storing the determined integrated evaluation values. For expel, the integrated evaluation value of the element of the first row and the first column is determined to be "37". The integrated evaluation value is determined by multiplying the weighting factor "4" to the entire evaluation value "8" stored in the element of the first row and the first column of the matrix (refer to FIG. 17) storing the entire evaluation values and adding the group evaluation value "5" stored in the element of the first row and the first column of the matrix (not shown) storing the group evaluation values.

FIG. 20 shows a matrix that is obtained by extracting only the elements included in the divided dither mask M1 from the integrated evaluation value matrix of FIG. 19. A total of 32 elements is included in the divided dither mask M1, and 6 elements among the 32 elements are already determined as the threshold value storage elements. The 6 threshold value storage elements are denoted by "COMPLETED".

If the integrated evaluation value determination process is performed, the procedure returns to the dither mask generation process shown in FIG. 9, in which the optimal storage position determination process is performed (Step S230). The storage element determination process is a process of determining the storage element of storing an objective threshold value (in the example, the threshold value corresponding to the dot having the 9-th easiness of formation). The storage element is determined among the elements having the smallest integrated evaluation values determined in Step S220, and in the example of FIG. 20, the storage element is the element of the first row and the 5-th column. In addition, in the case where pluralities of the elements have the same integrated evaluation value, one element may be selected as the candidate of the storage element storing the plurality of the elements. In this case, the selection method may be based on an expert's knowledge or according to the method described later.

If the process is performed on the threshold values from the threshold value corresponding to the dot having the highest easiness of formation to the threshold value corresponding to the dot having the highest difficulty of formation (Step S240), the generation of the dither mask 62 is completed.

Figure 21:
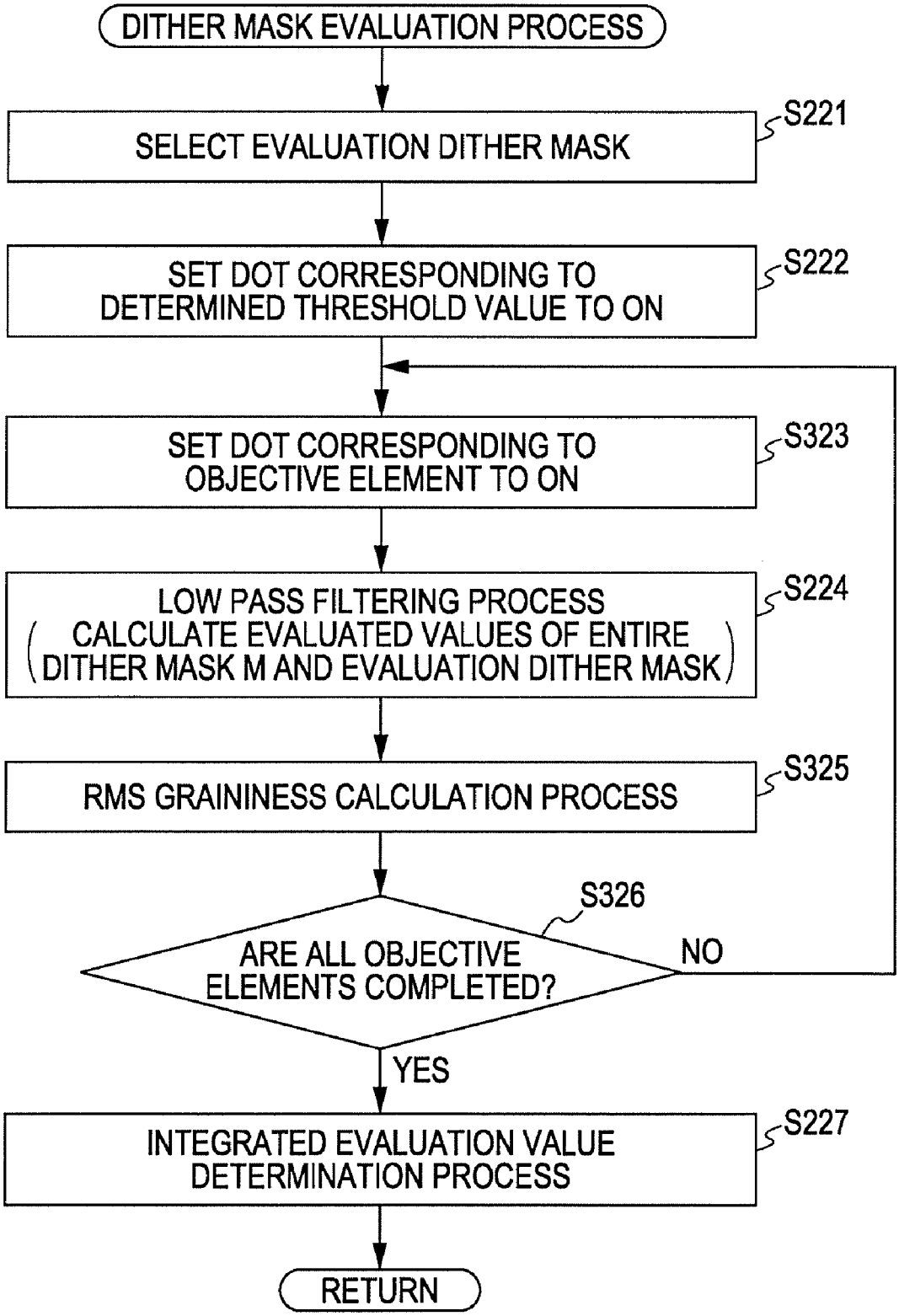
FIG. 21 is a flowchart showing a procedure of a dither mask evaluation process according to a second embodiment.

A-5-2. Generation Method for Dither Mask 62 according to Second Embodiment Now, a generation method for a dither mask 62 according to a second embodiment is described. FIG. 21 is a flowchart showing a procedure of the generation method for the dither mask 62 according to the second embodiment. The generation method of the second embodiment is different from that of the first embodiment in terms of a procedure of the dither mask evaluation process. In other words, the generation method is different from that of the first embodiment in that the dots are assumed to be formed at any one of a plurality of the pixels corresponding to the storage elements for the threshold values that are not in the determination-completed state, that is, a plurality of candidate elements that are not determined, and the storage elements are determined based on the RMS graininess of the dot pattern formed under the assumption.

As shown in FIG. 21, the dither mask evaluation process of the second embodiment can be implemented by adding a process of Step S323, a process of Step S325, and a process of Step S326 to the dither mask evaluation process (refer to FIG. 12) of the first embodiment. Therefore, in FIG. 21, the same processes as those of the first embodiment are denoted by the same reference numerals as those of FIG. 12, and the description thereof is omitted.

In Step S323, the dot of the pixel corresponding to the objective element is set to ON. The objective element is one element selected from a plurality of candidate elements. In Step S224, similarly to the first embodiment, the low pass filtering process is performed on the dot density matrix in which the dot of the pixel corresponding to the objective element is set to ON.

Figures 22, 23:
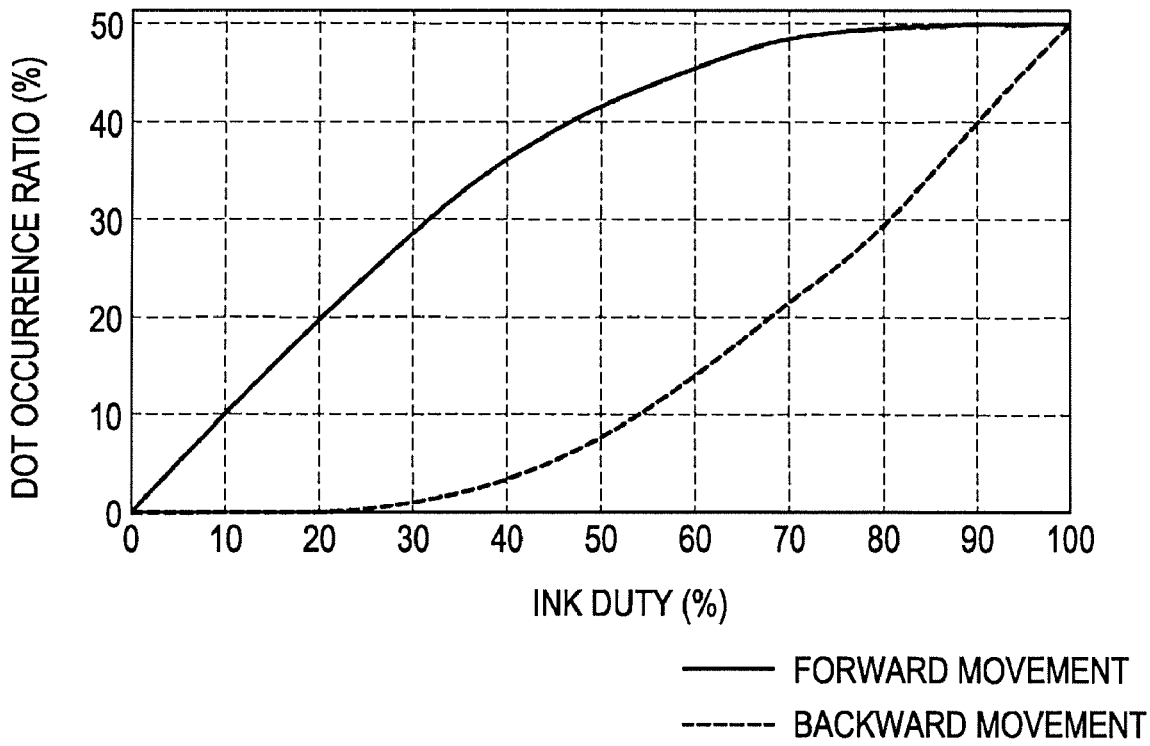
FIG. 22 is a view for explaining a calculation equation used for an RMS graininess calculation process in a dither mask evaluation process.
FIG. 23 is a view for explaining dot occurrence characteristics of a dither mask according to Modified Example 2.

In Step S325, an RMS graininess calculation process is performed. The RMS graininess calculation process is a process of calculating a standard deviation of the dot density distribution (evaluation values of elements by the low pass filtering process). The calculation of the standard deviation can be performed by using a calculation equation of FIG. 22. In addition, the calculation of the standard deviation is not necessarily performed on the dot density matrix corresponding to the entire elements of the entire dither mask M. In order to reduce a calculation amount, the calculation may be performed by using only the dot density matrix of the pixels included in a predetermined window (for example, a 5×5 partial matrix). The process is performed on all the objective pixels (Step S326).

The value calculated by the process corresponds to the entire evaluation value or group evaluation value of the first embodiment. In the second embodiment, the evaluation is performed based on the RMS graininess by treating the calculated entire evaluation value or group evaluation value in the same manner as that of the first embodiment, so that an optimal dither mask can be generated.

In addition, the evaluation method of the second embodiment can be combined with the evaluation method of the first embodiment. In other words, the candidate elements of the second embodiment may be reduced by the evaluation method of the first embodiment, and the storage elements may be determined from the reduced candidate elements based on the RMS graininess. For example, in Step S227 of the first embodiment, in the case where there are a plurality of the evaluation values having the same value, a plurality of elements having the corresponding evaluation value may be set to the candidate elements of the second embodiment. Moreover, the elements that are in a predetermined range of the evaluation value (for example, the difference in evaluation value is 5 or less) may be set to the candidate elements.

A-5-3. Generation Method for Dither Mask 62 According to Third Embodiment Now, a generation method for a dither mask 62 according to a third embodiment is described. Unlike the first or second embodiment, in which the low pass filtering process is performed and the optimality of the dither mask is evaluated based on the uniformity of the dot density or the RMS graininess, in the third embodiment, Fourier transformation is performed on the dot pattern and the optimality of the dither mask is evaluated by using a VTF function. More specifically, an evaluation scale (Graininess scale: GS value) that is used by Dooley et al., of Zerox may be applied to the dot pattern, and the optimality of the dither mask may be evaluated based on the GS value. Herein, the GS value is a graininess evaluation value that can be obtained by numericalizing the dot pattern through performing a predetermined process including two-dimensional Fourier transform on the dot pattern, by cascading a visually-sensitive spatial frequency characteristic VTF, and by performing integration (reference document: Fine Imaging and Hard Copy, Corona Company, edited by Associated Publication Committee of The Society of Photographic Science and Technology of Japan and The Imaging Society of Japan, P534). However, in the first and second embodiments, there is an advantage in that a complicated calculation such as Fourier transformation is not necessary.

A-6. Effects of the Invention

Each of the aforementioned dither mask 62 is set so that the dot occurrence ratio for the dots formed by the forward movement of the print head 90 and the dot occurrence ratio for the dots formed by the backward movement thereof are gradually increased with a magnitude relation where the dot occurrence ratio for the forward movement is larger than the dot occurrence ratio for the backward movement as the ink duty is increased. Therefore, since the dots formed on the printing medium P are biased to the dots formed by the forward movement of the print head 90, the difference in the dot forming timing in the sub scan direction in the main-scan-direction end portion of the printing medium P can be reduced. Accordingly, non-uniformity in concentration occurring in the sub scan direction in the bidirectional printing is suppressed, so that deterioration in the quality of a printing image can be suppressed.

In addition, as described above, the nozzle pattern of the printer 20 has a predetermined regularity. In the embodiment, whether or not the main scan direction in which the dots are formed is the forward-moving direction or the backward-moving direction is alternately changed every other raster. Therefore, if the dither mask 62 is applied to cover the upper, lower, left, and right sides of the image data that start with the pixel corresponding to the forward-moving dot forming position as the sub scan direction size of the dither mask 62 is set to a multiple number of the two rasters (dots), the elements of the divided dither mask M1 can be easily applied to the pixels corresponding to the forward-moving dot forming position, and the elements of the divided dither mask M2 can be easily applied to the pixels corresponding to the backward-moving dot forming position.

The effects are described in detail with reference to FIG. 4C. For example, the dot forming timing in the localized area from the position of the first row and the first column to the position of the second row and the second column is "LSL". However, if almost no dot is formed by the backward movement, the localized area is mostly occupied by the firstly formed dots and the thirdly formed dots (dots marked by "S"). In this case, the dot marked by "S" is a dot that is formed as a relatively long time elapses after the preceding dot is formed. In addition, the dot forming timing in the localized area from the position of the 15-th row and the first column to the position of the 16-th row and the second column is "SLS". However, if almost no dot is formed by the backward movement, the localized area is mostly occupied by the secondly formed dot (the first dot marked by "S") and the fourthly formed dot (the second dot marked by "S"). In this case, the dot marked by "S" is also a dot that is formed as a relatively long time elapses after the preceding dot is formed. In other words, in the left end of the printing medium P, since the dots that are formed as a relatively long time elapses after the preceding dot is formed are mainly formed in any localized area, the difference in the dot forming timing in the sub scan direction can be reduced. In addition, although the description thereof is omitted, the same description can be made in the right end of the printing medium P.

In addition, with respect to the dither mask 62, since the dots formed on the printing medium P are biased to the dots formed by the forward movement of the print head 90, the difference in the main scan direction order in the sub scan direction of the printing medium P can be reduced. Accordingly, non-uniformity in color accruing in the sub scan direction in the bidirectional printing is suppressed, so that deterioration in the quality of a printing image can be suppressed.

The effects are described in detail with reference to FIG. 6C. For example, the main scan direction order in the raster from the first row to the 14-th row is "→←→←". However, if almost no dot is formed by the backward movement, the main scan direction order is close to "→→" as a whole. In addition, the main scan direction order in the raster from the 15-th row to the 30-th row is "→←→←". However, if almost no dot is formed by the backward movement, the main scan direction order is close to "→→" as a whole. In other words, with respect to any raster, the uniform configuration of dots is made mainly by the dots formed by the forward movement, so that the difference in the main scan direction order in the sub scan direction can be reduced.

In addition, in the dither mask 62, each threshold value is set so that the forward-moving dot occurrence ratio and the backward-moving dot occurrence ratio are gradually increased as the ink duty is increased. Therefore, since a difference between the forward-moving dot occurrence ratio and the backward-moving dot occurrence ratio is not rapidly changed, the changing points are not noticeable, so that deterioration in the quality of a printing image can be suppressed.

In addition, due to the aforementioned generation method, with respect to the dither mask 62, the dot dispersiveness as the entire dither mask M is secured, and moreover, the dot dispersivenesses as the divided dither masks M1 and M2 (the dot group formed by the forward movement of the print head 90 and the dot group formed by the backward movement) are also secured. Therefore, as described above, even in that case where the dot occurrence ratio of the dots formed by the forward movement and the dot occurrence ratio of the dots formed by the backward movement are biased to the dot occurrence ratio of the forward movement, since the dot dispersiveness as the entire image can be secured, deterioration in the quality of a printing image can be suppressed.

In addition, due to the aforementioned generation method, the dither mask 62 has the following characteristics. Firstly, the RMS graininess of the low frequency components of the dot pattern formed in each of the pixel group where the dots are formed by the forward movement (hereinafter, referred to as a first pixel group) and the pixel group where the dots are formed by the backward movement (hereinafter, referred to as a second pixel group) is smaller than the RMS graininess of the low frequency components of the dot pattern formed in pixel groups that constitute an image by combining in a common printing area, wherein the pixel groups are obtained by division other than the division of the first and second pixel groups.

Secondly, all the uniformities of the dot density distributions of the low frequency components of the dot pattern formed in each of the first and second pixel groups are higher than the uniformities of the dot density distributions of the dot pattern formed in pixel groups that constitute an image by combining in a common printing area, wherein the pixel groups are obtained by division other than the division of the first and second pixel groups.

Thirdly, the graininess evaluation value that is calculated based on the value obtained by applying Fourier transformation on the dot pattern formed in each of the first and second pixel groups and visually-sensitive spatial frequency characteristic function is smaller than the graininess evaluation value of the dot pattern formed in pixel groups that constitute an image by combining in a common printing area, wherein the pixel groups are obtained by division other than the division of the first and second pixel groups.

Fourthly, all the group RMS graininesses that are the RMS graininesses of the low frequency components of the dot pattern formed in each of the first and second pixel groups are close to the entire RMS graininess (that is, the RMS graininess of the low frequency components of the dot pattern formed in the entire pixels constituting an image) of the dither mask 62 rather than any one of the group RMS graininesses of a virtual dither mask, of which entire RMS graininess is configured to be smaller than that of the dither mask 62.

Fifthly, all the group dot uniformities that are the uniformities of the dot density distributions of the low frequency components of the dot pattern formed in each of the first and second pixel groups are close to the entire dot uniformity (that is, the uniformity of the dot density distribution of the low frequency components of the dot pattern formed in the entire pixels constituting an image) of the dither mask 62 rather than any one of the group dot uniformities of a virtual dither mask, of which entire dot uniformity is configured to be higher than that of the dither mask 62.

Sixthly, all the group graininess evaluation values that are graininess evaluation values calculated based on the value obtained by applying Fourier transformation on the dot pattern formed in each of the first and second pixel groups and the visually-sensitive spatial frequency characteristic function are close to the entire graininess evaluation value (that is, the graininess evaluation value of the dot pattern formed in the entire pixels constituting an image) of the dither mask 62 rather than any one of the group graininess evaluation values of a virtual dither mask, of which the entire graininess evaluation value is configured to be smaller than that of the dither mask 62.

The above six characteristics cannot be obtained if the characteristics are not configured by taking into consideration a dot dispersiveness of any one of the first and second pixel groups.

B. MODIFIED EXAMPLES

Modified Examples of the aforementioned embodiments will be described.

B-1. Modified Example 1

In the aforementioned embodiments, the dot occurrence ratio of the dots formed by the forward movement of the print head 90 and the dot occurrence ratio of the dots formed by the backward movement are controlled so that the dot occurrence ratios are gradually increased as the ink duty is increased in a magnitude relation that the forward-moving dot occurrence ratio is larger than the backward-moving dot occurrence ratio. However, even in the case where the dot occurrence ratios are controlled so that the backward-moving dot occurrence ratio is larger than the forward-moving dot occurrence ratio, the same effects can be obtained. In other words, the dot occurrence ratios are preferably biased in a magnitude relation that any one of the forward-moving dot occurrence ratio and the backward-moving dot occurrence ratio is relatively large.

In addition, the configuration that the dot occurrence ratio is biased to any one of the forward-moving dot occurrence ratio and the backward-moving dot occurrence ratio can be implemented by suitably selecting various conditions such as a property and state of ink and a quality of the printing medium P. For example, in a printing condition that good color formation is obtained by ejecting the cyan ink C, the magenta ink M, the yellow ink Y, and the black ink K on the printing medium P in this order, in the case of the nozzle arrangement shown in FIG. 2, the dot occurrence may be biased to the forward-moving dot occurrence.

B-2. Modified Example 2

In the aforementioned embodiments, the dot occurrence ratios are configured to be controlled so that the dots are formed by the forward movement and the backward movement in the printing area with all ink duties and so that the forward-moving dot occurrence ratio and the backward-moving dot occurrence ratio are gradually increased with a biased magnitude relation. However, the dot occurrence ratios may be controlled in a limited range of the ink duty. For example, the dot occurrence ratios shown in FIG. 23 may be used.

In this example, as shown in the figure, in the printing area where the ink duty is smaller than 20%, the forward-moving dot occurrence ratio is 0. In other words, the dots are formed only by the forward movement. In addition, in the printing area where the ink duty is equal to or larger than 20% and equal to or smaller than 85%, the forward-moving dot occurrence ratio is gradually increased so that an increase ratio is decreased as the ink duty is increased, and the backward-moving dot occurrence ratio is gradually increased so that the increase ratio is increased as the ink duty is increased. In the printing area where the ink duty is 85%, the forward-moving dot occurrence ratio reaches to the maximum value 50%. In addition, in the printing area where the ink duty is larger than 85%, the forward-moving dot occurrence ratio is the constant value 50%, and the backward-moving dot occurrence ratio is gradually increased as the ink duty is increased. In other words, each threshold value of the dither mask 62 is set so that the forward-moving dot occurrence ratio and the backward-moving dot occurrence ratio are gradually increased with a biased magnitude relation in an area where the ink duty is equal to or larger than 20% and equal to or smaller than 85%. Although the dot occurrence ratios are controlled in the above manner, the forward-moving dot occurrence ratio and the backward-moving dot occurrence ratio are biased and gradually changed, so that the same effects as those of the embodiments can be obtained.

Alternatively, the dot occurrence ratios may be controlled so that the forward-moving dot occurrence ratio and the backward-moving dot occurrence ratio in the printing area having a low duty are almost equal to each other and so that the forward-moving dot occurrence ratio and the backward-moving dot occurrence ratio in the printing area having a medium duty are gradually increased with a biased magnitude relation. This is because, in the printing area having a low duty, the dot density is low, and the dots are formed to be separated by a certain distance from each other, so that the non-uniformity in concentration caused by the difference in the dot forming timing cannot easily occur.

B-3. Modified Example 3

Figure 24:
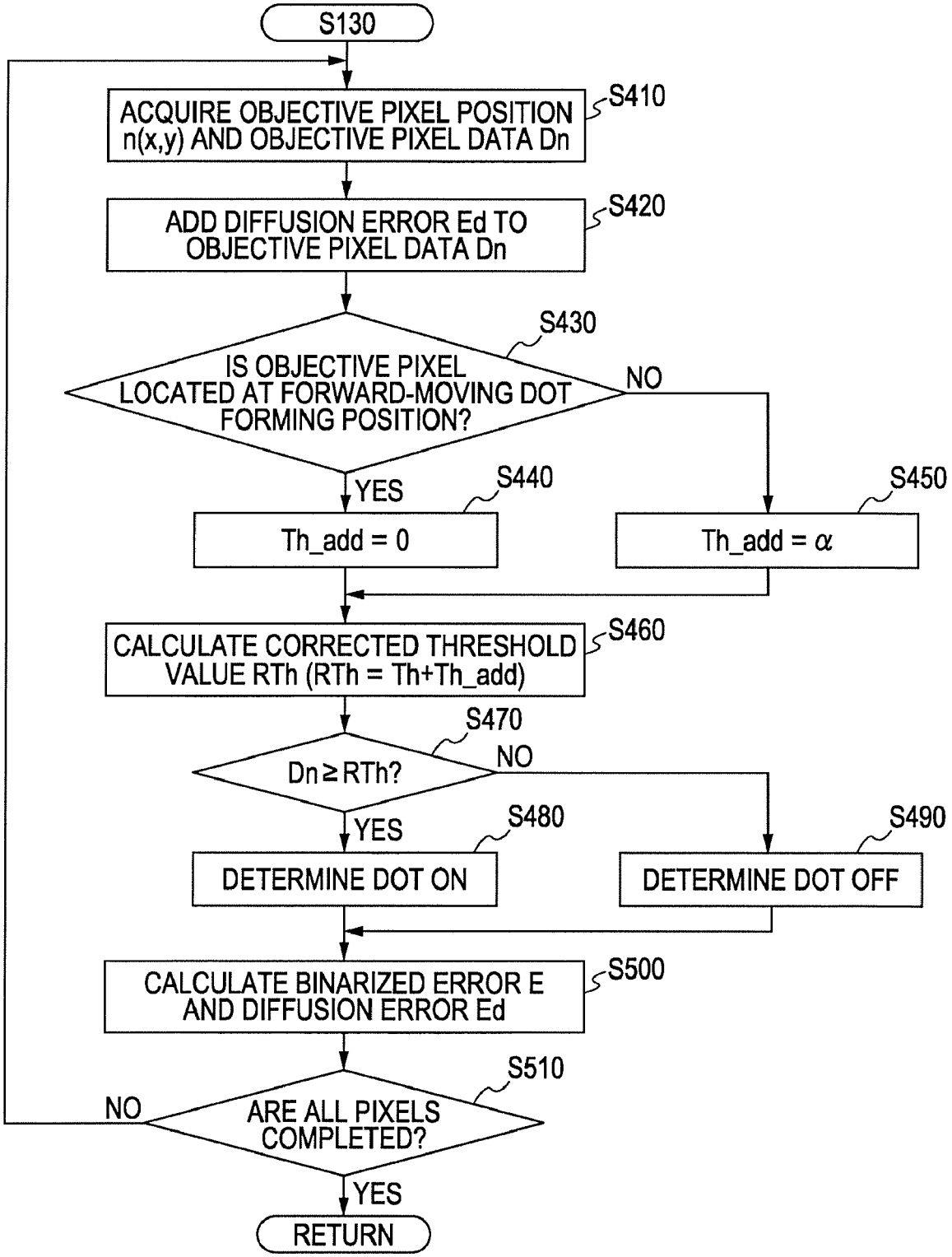
FIG. 24 is a flowchart showing a procedure of a halftone process of a printer according to Modified Example 3.

In the aforementioned embodiments, the dot occurrence ratios shown in FIG. 8 are configured to be implemented by performing the halftone process of Step S130 using the systematic dithering method. However, in the Modified Example 3, the dot occurrence ratios are configured to be implemented by performing the halftone process using an error diffusion method. The flow of the halftone process (Step S130) according to Modified Example 3 is shown in FIG. 24. The process is a process that the CPU 40 executes as the process of the halftone processing unit 42. In addition, in the process, the steps except for the later-described Steps S430 to S460 are the procedures of the halftone process using the error diffusion method of the related art. The procedures of the related art are described in brief. If the process starts, the CPU 40 firstly acquires coordinate data n(x,y) of the position of the objective pixel and objective pixel data Dn from image data that are color-transformed in Step S120 (Step S410).

If the coordinate data n(x,y) of the position of the objective pixel and the objective pixel data Dn are acquired, the CPU 40 adds a diffusion error Ed to the objective pixel data Dn (Step S420). Herein, since the diffusion error Ed is calculated in the later-described Step S500, the detailed description is made later.

If the diffusion error Ed is added to the objective pixel data Dn, the CPU 40 determines whether or not the objective pixel corresponds to the dot forming position where the dots are formed by the forward movement of the print head 90 (Step S430). In addition, as shown in FIGS. 4 and 5, since the nozzle patterns and the main scan direction (forward-moving direction or backward-moving direction) patterns occur repetitively in a constant period, the determination can be easily performed if the patterns are stored in the EEPROM 62 and if the patterns are used in combination with the coordinate data n(x,y) of the positions of the objective pixels.

As a result, if the objective pixel corresponds to the dot forming position for the forward movement (Step S430: YES), the CPU 40 sets a threshold value-to-be-added value Th_add to a value 0 (Step S440). The threshold value-to-be-added value Th_add is a value that is to be added to a threshold value Th used for the determination of the ON/OFF of the dot in the error diffusion method of the related art. On the other hand, if the objective pixel corresponds to the dot forming position for the backward movement (Step S430: NO), the CPU 40 sets the threshold value-to-be-added value Th_add to a value $\alpha$ (Step S450). Herein, $\alpha$ is a positive integer.

If the threshold value-to-be-added value Th_add is set to the value 0 or the value $\alpha$, the CPU 40 adds the threshold value-to-be-added value Th_add to the threshold value Th used for the determination of the ON/OFF of the dot in the error diffusion method of the related art, so that a corrected threshold value RTh is calculated (Step S460).

If the corrected threshold value RTh is calculated, the CPU 40 compares the objective pixel data Dn with the corrected threshold value RTh (Step S470). As a result, if the objective pixel data Dn is equal to or larger than the corrected threshold value RTh (Step S470: YES), the CPU 40 determines the dot of the objective pixel to be ON (Step S480). If the objective pixel data Dn is smaller than the corrected threshold value RTh (Step S470: NO), the CPU 40 determines the dot of the objective pixel to be OFF (Step S490).

If the ON/OFF of the dot is determined, the CPU 40 calculates a binarized error E and the diffusion error Ed (Step S500). The binarized error E is a difference between the objective pixel data Dn and the result of ON/OFF of the dot (herein, gradation value 0 or 255). The diffusion error Ed is an error that is added to the objective pixel data Dn in the aforementioned Step S420. In the embodiment, the ¼ times the binarized error E is distributed to each of the upper, lower, left, and right pixels with respect to the objective pixel. In addition, in the embodiment, since only the ON/OFF of the dots are determined, the diffusion error Ed is calculated based on the binarized error E. However, the diffusion error Ed may be calculated based on a quantization error. For example, in the case where the ON/OFF of the large dot and the small dot are determined in Steps S480 and S490, the diffusion error Ed may be calculated based on a multi-valued error.

Next, if the binarized error E and the diffusion error Ed are calculated, the CPU 40 repeats the aforementioned Steps S410 to S500 with respect to all the pixels as the objective pixels (Step S510). Accordingly, the halftone process of Step S130 is ended.

Although the halftone process of Step S130 is performed in this manner, in the case where the dots corresponding to the objective pixels are formed by the backward movement, only the value $\alpha$ in the threshold value used for the determination of the ON/OFF of dots is relatively large, the dots cannot easily formed at the dot forming positions of the corresponding dots, so that the forward-moving and backward-moving dot occurrence ratios can be close to the dot occurrence ratio shown in FIG. 8.

In addition, if the value $\alpha$ of the threshold value-to-be-added value Th_add is optimized as a function of an input gradation value, the dot occurrence ratio can be more finely controlled according to the input gradation value, that is, the ink duty. In addition, even in the case where the objective pixel is determined to be the pixel corresponding to the forward movement in Step s430 (Step S430: YES), if the threshold value-to-be-added value Th_add is set to the value $\beta$ that is optimized as a function of the input gradation value in Step S440, the greater effect can be obtained. In addition, in the printing area where the ink duty is in a predetermined range, in order that the forward-moving dot occurrence ratio and the backward-moving dot occurrence ratio are controlled to be gradually increased as the ink duty is increased, for example, if the input gradation value is not included in the aforementioned predetermined range, the value $\alpha$ may be set to 0.

B-4. Modified Example 4

Figure 25:
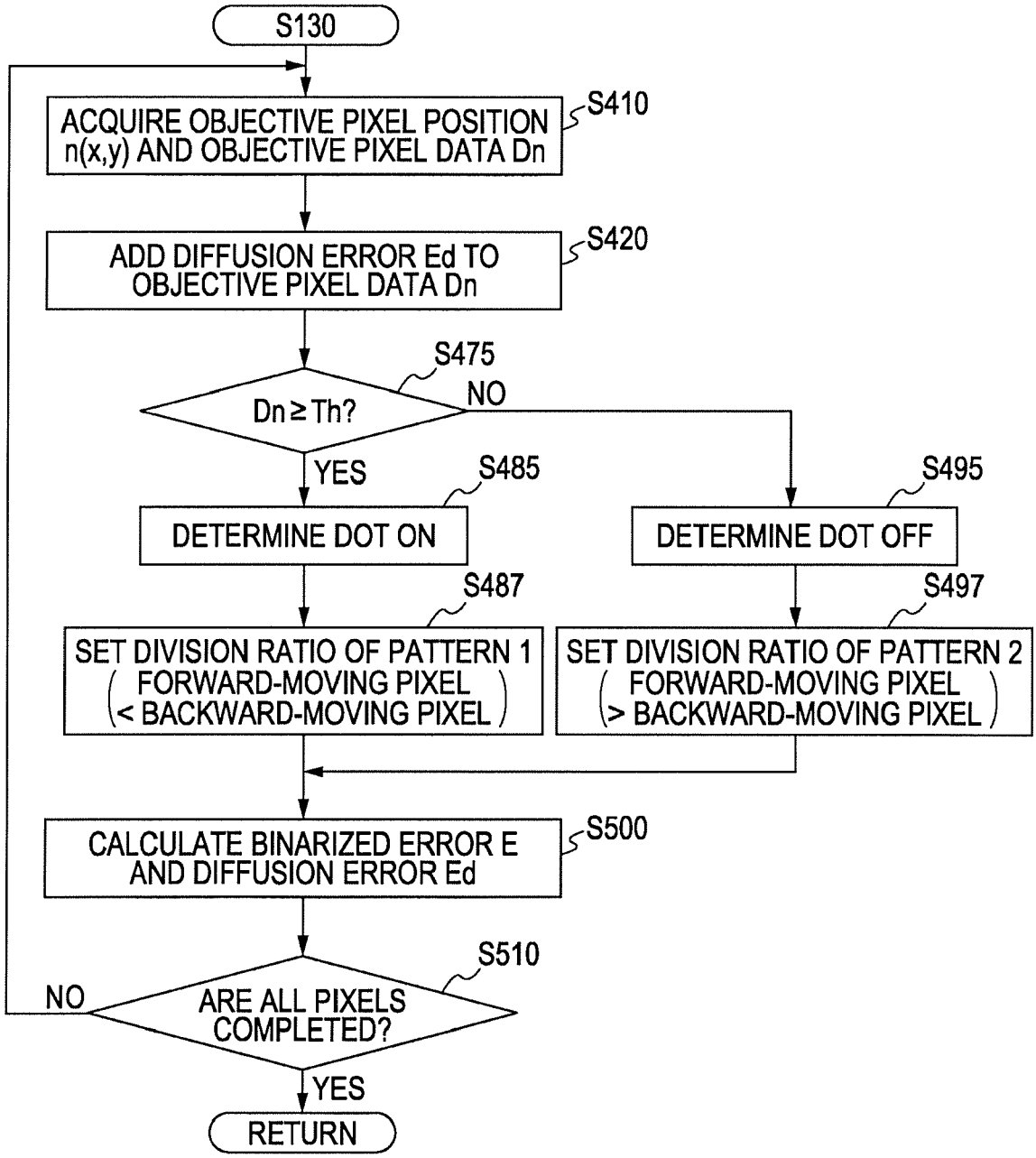
FIG. 25 is a flowchart showing a procedure of a halftone process of a printer according to Modified Example 4.

An example where the dot occurrence ratio shown in FIG. 8 is implemented by a halftone process using an error diffusion method in a configuration different from that of Modified Example 3 is described. A flow of the halftone process (Step S130) according to Modified Example 4 is shown in FIG. 25. The process is different from that of Modified Example 3 in that Steps S430 to S500 of the halftone process of Modified Example 1 shown in FIG. 24 are replaced with Steps S475 to S505. In addition, the same steps as those of the first embodiment are denoted by the same reference numerals, and the description thereof is omitted.

In Modified Example 4, if the diffusion error Ed is added to the objective pixel data Dn (Step S420), the CPU 40 compares the objective pixel data Dn to the threshold value Th (Step S475). As a result, if the objective pixel data Dn is equal to or higher than the threshold value Th (Step S475: YES), the dot of the objective pixel is determined to be "ON" (Step S485). If the objective pixel data Dn is lower than the threshold value Th (Step S475: NO), the dot of the objective pixel is determined to be "OFF" (Step S495).

If the ON/OFF of the dot is determined, in the case where the dot is determined to be "ON" (Step S485), the CPU 40 sets the distribution ratio of the binarized error E to the pattern 1 (Step S487). With respect to the distribution ratio of the pattern 1, the distribution ratio to the pixels corresponding to the dots formed by the backward movement is larger than the distribution ratio to the pixels corresponding to the dots formed by the forward movement. In the embodiment, the distribution ratio to the pixels corresponding to the backward movement is set to three times the distribution ratio to the pixels corresponding to the forward movement. In addition, in the case where the dot is determined to be set to OFF (Step S495), the distribution ratio of the binarized error is set to the pattern 2 (Step S497). With respect to the distribution ratio of the pattern 2, the distribution ratio to the pixels corresponding to the forward movement is larger than the distribution ratio to the pixels corresponding to the backward movement. In the embodiment, the distribution ratio to the pixels corresponding to the forward movement is set to three times the distribution ratio to the pixels corresponding to the backward movement.

If the distribution ratio of the binarized error E is set, the CPU 40 calculates the binarized error E. In addition, the CPU 40 calculates the diffusion error Ed based on the distribution ratio set in the Step S487 or S497 (Step S505). In the embodiment, the distribution is performed on the four pixels, that is, the upper, lower, left, and right pixels of the objective pixel. For example, in the case where the objective pixel is the pixel corresponding to the dot formed by the backward movement, when the distribution ratio is set to the pattern 1, the ⅛ of the binarized error E is distributed as the diffusion error Ed to the two upper and lower pixels (corresponding to the forward movement) of the objective pixel, and ⅜ binarized error E is distributed as the diffusion error Ed to the two left and right pixels (corresponding to the backward movement) of the objective pixel.

Even in the case where the halftone process of Step S130 is performed in this manner, when the dot is determined to be set to ON, the binarized error E having a minus value is relatively largely distributed to the pixels corresponding to the backward movement, and when the dot is determined to be set to OFF, the binarized error E having a plus value is relatively largely distributed to the pixels corresponding to the forward movement. Therefore, if the dot is determined to be set to any one of the ON and OFF, the dot can be easily formed by the forward movement. Therefore, the forward-moving and backward-moving dot occurrence ratios can be close to the dot occurrence ratio shown in FIG. 8.

In addition, similarly to Modified Example 3, if the aforementioned distribution ratio is optimized as a function of the input gradation value, the dot occurrence ratio can be more finely controlled according to the input gradation value, that is, the ink duty. In addition, in the printing area where the ink duty is in a predetermined area, in order that the forward-moving dot occurrence ratio and the backward-moving dot occurrence ratio are controlled to be gradually increased as the ink duty is increased, for example, if the input gradation value is not included in the aforementioned predetermined range, the distribution ratio to the pixels corresponding to the forward movement and to the pixels corresponding to the backward movement may be configured to be equal to each other. In addition, in the embodiment, with respect to the binarized error E at the time of the dot ON and the binarized error E at the time of the dot OFF, the distribution ratio is configured to be biased to the pixels corresponding to the forward movement and the pixels corresponding to the backward movement. However, with respect to any one of the binarized errors E at the time of the dot ON or at the time of the dot OFF, although the distribution ratio may be configured to be biased to any one thereof, a certain degree of the effect can be obtained.

B-5. Modified Example 5

In the embodiments, with respect to all the nozzle columns 92 to 97, the printing is configured to be performed with the dot occurrence ratio shown in FIG. 8. However, in the case where the printing is performed by two or more ink colors, which one of the forward movement and the backward movement the dot occurrence ratio is biased to may be changed according to the ink color. For example, in the configuration of the printer 20 shown in the embodiment, two types of dither mask including the dither mask where the dot occurrence ratio is biased to the forward-moving dot occurrence ratio and the dither mask where the dot occurrence ratio is biased to the backward-moving dot occurrence ratio may be stored in the EEPROM 62, and the CPU 40 may change the dither mask used for the halftone process between the two types of the dither mask according to the ink color. Therefore, the time interval where the ink is ejected between the ink colors of which the dither masks are changed, that is, between the ink color of the ink ejected mainly by the forward movement and the ink color of the ink ejected mainly by the backward movement can be increased, so that the ink cannot easily be smeared. Accordingly, quality of a printing image can be improved.

B-6. Modified Example 6

In the aforementioned embodiments, the printer 20 is configured as a color printer. However, the same effects can be obtained even by a printer performing black-and-white printing. In addition, in the aforementioned embodiments, the printer 20 is configured so that the overlap number is set to 2 and the nozzle pitch is set to 2. The invention can be adapted irrespective of the overlap number and the nozzle pitch number.

B-7. Modified Example 7

In the aforementioned embodiments, the printer 20 is configured to perform all the printing processes of FIG. 2. In the case where the printer 20 is connected to a computer, some portions of the printing processes may be executed by the computer. In this case, a printing system including the computer and the printer 20 can be treated as a printing apparatus in a broad sense.

Hereinbefore, various embodiments of the invention are described, but the invention is not limited to the embodiments. Various changes and modifications can be made without departing from the spirit of the invention. For example, the invention is not limited to the printing apparatus according to the embodiments, but it may be implemented as a dither mask, a program, a printing method, and a dither mask generation method.

This application claims priority to Japanese Patent Application No. 2008-309343, filed Dec. 4, 2008, the entirety of which is incorporated by reference herein.

What is claimed is:

1. A printing apparatus that performs printing by moving a print head in main scan directions relative to a printing medium, comprising:

an input unit that inputs image data constituting an image;

a halftone processing unit that converts the input image data to dot data indicating whether or not dots are formed; and a printing unit that performs printing by controlling ejection of ink from the print head based on the result of the halftone process, in a printing area where an ink duty is in a predetermined range, the printing unit being configured to form dots by a relative forward movement in which the print head relatively moves in a first direction of the main scan directions and backward movement in which the print head relatively moves in a second direction opposite to the first direction so that a forward-moving dot occurrence ratio that is a ratio of forming the dots by the relative forward movement with respect to the ink duty is decreased, as the ink duty is increased, and so that a backward-moving dot occurrence ratio that is a ratio of forming the dots by the relative backward movement with respect to the ink duty is increased, as the ink duty is increased.

2. The printing apparatus according to claim 1, wherein the halftone processing unit compares a dither mask constructed with a plurality of threshold values with the image data to generate the dot data, and wherein the plurality of threshold values of the dither mask are set so that the forward-moving dot occurrence ratio and the backward-moving dot occurrence ratio are gradually increased with the biased magnitude relation in the printing area.

3. The printing apparatus according to claim 2, wherein the plurality of threshold values of the dither mask are set so that dot dispersiveness of any one of the dots formed by the forward movement, the dots formed by the backward movement, and the entire dots formed by the relative forward movement and the relative backward movement can be secured.

4. The printing apparatus according to claim 1, wherein the halftone processing unit generates the dot data by an error diffusion method of quantizing the image data by comparing the image data with the predetermined threshold value while adding quantization errors of the image data to surrounding image data with a predetermined distribution ratio, so that the predetermined threshold value used to determine whether or not the dot is formed at any one of the dot forming position at which the dot is formed by the relative forward movement and the dot forming position at which the dot is formed by the relative backward movement in the printing area is relatively increased according to the dot forming position.

5. The printing apparatus according to claim 1, wherein the halftone processing unit generates the dot data by an error diffusion method of quantizing the image data by comparing the image data with the predetermined threshold value while adding quantization errors of the image data to surrounding image data with a predetermined distribution ratio, so that the quantization errors at the time of determining that the dots are formed in the printing area are added with a relatively high distribution ratio that is set to any one of the image data corresponding to the dot forming position at which the dots are formed by the relative forward movement and the image data corresponding to the dot forming position at which the dots are formed by the relative backward movement.

6. The printing apparatus according to claim 1, wherein the halftone processing unit generates the dot data by an error diffusion method of quantizing the image data by comparing the image data with the predetermined threshold value while adding quantization errors of the image data to surrounding image data with a predetermined distribution ratio, so that the quantization errors at the time of determining that the dots are not formed in the printing area are added with a relatively low distribution ratio that is set to any one of the image data corresponding to the dot forming position at which the dots are formed by the relative forward movement and the image data corresponding to the dot forming position at which the dots are formed by the relative backward movement.

7. The printing apparatus according to claim 1, wherein the printing unit at least controls ejection of a first ink having a predetermined ink color and a second ink having an ink color different from that of the first ink, so that the forward-moving dot occurrence ratio is larger than the backward-moving dot occurrence ratio with respect to the first ink, and so that the backward-moving dot occurrence ratio is larger than the forward-moving dot occurrence ratio with respect to the second ink.

8. A dither mask that is constructed with a plurality of threshold values to be used for a halftone process for performing printing by moving a print head in main scan directions relative to a printing medium, wherein, in a printing area where an ink duty is in a predetermined range, dots are formed by a relative forward movement in which the print head relatively moves in a first direction of the main scan directions and a relative backward movement in which the print head relatively moves in a second direction opposite to the first direction, and wherein the plurality of threshold values are set so that a forward-moving dot occurrence ratio that is a ratio of forming the dots by the relative forward movement with respect to the ink duty is decreased, as the ink duty is increased, and so that a backward-moving dot occurrence ratio that is a ratio of forming the dots by the relative backward movement with respect to the ink duty is increased, as the ink duty is increased.

* * * * *